US011566503B1

(12) United States Patent
Alhussain et al.

(10) Patent No.: US 11,566,503 B1
(45) Date of Patent: Jan. 31, 2023

(54) OIL RECOVERY OF A RESERVOIR BASED ON RESIDUAL OIL SATURATION

(71) Applicant: Saudi Arabian Oil Company, Dhahran (SA)

(72) Inventors: Hassan Mohammed Alhussain, Dammam (SA); Noor A. Saif, Qatif (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/480,734

(22) Filed: Sep. 21, 2021

(51) Int. Cl.
*E21B 43/20* (2006.01)
*E21B 47/10* (2012.01)

(52) U.S. Cl.
CPC ..... *E21B 43/20* (2013.01); *E21B 47/10* (2013.01)

(58) Field of Classification Search
CPC ..... E21B 43/20; E21B 47/10
USPC ..... 166/250.01
See application file for complete search history.

(56) References Cited

U.S. PATENT DOCUMENTS

| | | | | |
|---|---|---|---|---|
| 9,261,435 | B2 | 2/2016 | Collins et al. | |
| 9,534,481 | B2 | 1/2017 | Ayan et al. | |
| 10,007,015 | B2 | 6/2018 | Gray et al. | |
| 10,416,063 | B2 * | 9/2019 | Gao | G01N 15/082 |
| 2019/0026405 | A1 * | 1/2019 | Ramsay | G06F 30/00 |
| 2019/0040303 | A1 * | 2/2019 | Ma | E21B 43/16 |
| 2019/0093469 | A1 | 3/2019 | Williams et al. | |
| 2020/0371051 | A1 * | 11/2020 | Chen | G01N 13/00 |

FOREIGN PATENT DOCUMENTS

| | | |
|---|---|---|
| EP | 2261459 | 12/2010 |
| EP | 2513678 | 1/2015 |
| RU | 2573739 | 1/2016 |

OTHER PUBLICATIONS

Aboujafar et al., "Effect of Oil Viscosity and Brine Salinity/Viscosity on Water/Oil Relative Permeability and Residual Saturation" Society of Petrophysicists and Well-Log Analysts, 55th Annual Logging Symposium, May 18-22, 2014, 19 pages.
Bashiri et al., "Properly Use Effect of Capillary Number on Residual Oil Saturation" Society of Petroleum Engineers, SPE 150800, Aug. 2011, 3 pages.

(Continued)

*Primary Examiner* — William D Hutton, Jr.
*Assistant Examiner* — Ashish K Varma
(74) *Attorney, Agent, or Firm* — Fish & Richardson P.C.

(57) ABSTRACT

The systems and method described in this specification relate to a method for determining a residual oil saturation of a reservoir. The method includes obtaining a plurality of rock samples from the reservoir; determining a permeability of each of the rock samples; measuring a fluid viscosity of oil in the reservoir; estimating a location-specific permeability of the reservoir across the reservoir based on the permeability of each of the rock samples; determining a location-specific displacing velocity of the reservoir based on a function of the location-specific permeability and the fluid viscosity of the oil; determining the residual oil saturation of the reservoir based on the location-specific displacing velocity using Franklin's equation; and predicting a recovery of the oil from the reservoir using the residual oil saturation in a computational model of the reservoir.

20 Claims, 16 Drawing Sheets

(56) References Cited

OTHER PUBLICATIONS

Core Analysis: A Best Practice Guide book (2015 Edition, Chapter 10), 521-653, 139 pages.
Nejad et al., "Effect of oil viscosity on water/oil relative permeability." International symposium of the society of core analysts, Sep. 2011, 12 pages.
Ramey Jr., "Correlations of Surface and Interfacial Tensions of Reservoir Fluids." Society of Petroleum Engineers, SPE-4429-MS, Jan. 1973, 27 pages.
Teklu et al., "Residual oil saturation determination—case studies in sandstone and carbonite reservoirs" Society of Petroleum Engineers, Eage Annual Conference & Exhibition, SPE 164825, Jun. 2013, 8 pages.
Wang et al., "Effect of Oil Viscosity on Heavy-Oil/Watcr Relative Permeability Curves" Society of Petroleum Engineers, SPE 99763, Apr. 2006, 9 pages.
Whitson et al., "Phase behavior" vol. 20. Richardson, TX: Henry L. Doherty Memorial Fund of AIME, Society of Petroleum Engineers, 2000, 242 pages.

* cited by examiner

COMPARISON BETWEEN CALCULATED SOR AND STATOIL EXPERIMENT SOR IN TABLE 1

OIL RECOVERY OF A RESERVOIR BASED ON RESIDUAL OIL SATURATION

TECHNICAL FIELD

The present disclosure describes systems and methods for determining a residual oil saturation of a reservoir and, more particularly, predicting a recovery of oil from the reservoir using the residual oil saturation in a computational model of the reservoir and pumping a displacement fluid into the reservoir to cause the oil recovery.

BACKGROUND

Oil wells can be used to recover oil from a subterranean reservoir. The amount of oil recovered from the well generally decreases over time as oil becomes trapped within microstructures of the rock that make up the reservoir. Waterflooding can be used to aid in the recovery of the oil, but eventually the amount of energy needed to displace the trapped oil becomes so prohibitive that the well is sometimes abandoned.

Residual oil saturation ($S_{or}$) is the remaining oil saturation in a reservoir. In some examples, residual oil saturation is defined as the saturation achieved after an infinite number of pore volumes of a displacing fluid (e.g., water) have flowed through a particular portion of reservoir. The residual oil saturation represents the ratio of a volume of the residual hydrocarbon divided by the effective porosity of the rock of the reservoir (e.g., shale, sandstone, etc.). A reservoir with a residual oil saturation of zero (or 0%) means that all oil has been recovered and no residual oil remains. A reservoir with a residual oil saturation of one (or 100%) means that all the oil is residual hydrocarbon that cannot be recovered.

Several methods are available to determine residual oil saturation, but these methods generate different results with varying accuracy. Some methods include lab experiments (e.g., sponge core, centrifuge, and steady state water-flood tests), single well tracer experiments, and logging experiments (e.g., resistivity, log-inject-log, electromagnetic propagation, and NMR). These experiments are expensive to conduct and/or difficult to implement. It is especially difficult to implement these experiments in low-permeability rocks, heavy-oil fields, or fields with a large oil viscosity variation (e.g., horizontally or vertically). Another way to determine residual oil saturation is by using Aboujafar's method but Aboujafar's method does not account for permeability variations in the reservoir and can be inaccurate.

It can also be impractical to conduct lab experiments using heavy oil or multiple oil properties since these experiments are costly and require a long time to obtain results. For example, interfacial tension tests and wettability tests to determine parameters to determine residual oil saturation are time consuming because they oftentimes require repeated measurements to obtain accurate results.

SUMMARY

The systems and methods described in this specification relate to determining residual oil saturation of a reservoir. The systems and method described in this specification determine displacing velocity as a function of permeability of the reservoir and the viscosity of an oil of the reservoir. This approach allows the displacing velocity to vary throughout the reservoir which improves the accuracy of the residual oil saturation values. This new approach with displacing velocity is used in combination with Franklin's equation to determine residual oil saturation that is more accurate (and more conservative) that historical methods. The resulting residual oil saturation values can be used in computational models to predict a recovery of the oil from the reservoir. In some examples, the recovery is used to identify drilling sites, estimate reservoir reserves and to determine enhanced oil recovery (EOR) of the reservoir.

Some systems and methods for determining a residual oil saturation of a reservoir include obtaining a plurality of rock samples from the reservoir and determining a permeability of each of the rock samples. Some systems and methods also include measuring a fluid viscosity of oil in the reservoir and estimating a location-specific permeability of the reservoir across the reservoir based on the permeability of each of the rock samples. Some systems and methods also include determining a location-specific displacing velocity of the reservoir based on a function of the location-specific permeability and the fluid viscosity of the oil. The function has a proportional relationship to the location-specific permeability and an inverse relationship to the fluid viscosity. Some systems and methods also include determining the residual oil saturation of the reservoir based on the location-specific displacing velocity using Franklin's equation and predicting a recovery of the oil from the reservoir using the residual oil saturation in a computational model of the reservoir.

Some systems and methods for determining a residual oil saturation of a reservoir include determining a location-specific displacing velocity of the reservoir and determining the residual oil saturation of the reservoir based on the location-specific displacing velocity using Franklin's equation. The location-specific displacing velocity represents a velocity of an interface between an oil and a displacing fluid within the reservoir. Some systems and methods also include predicting a recovery of the oil from the reservoir using the residual oil saturation in a computational model of the reservoir and pumping the displacing fluid into the reservoir to cause the recovery of the oil from the reservoir.

Some systems and methods for determining a residual oil saturation of a reservoir include estimating a fluid viscosity of the oil in the reservoir and estimating a location-specific permeability of the reservoir across the reservoir. Some systems and methods also include determining a location-specific displacing velocity of the reservoir by evaluating the following equation: nu=c*k*mu^(−2), where nu is the location-specific displacing velocity, c is a constant, k is the location-specific permeability of the reservoir, and mu is the fluid viscosity of an oil of the reservoir. Some systems and methods also include determining the residual oil saturation of the reservoir based on the location-specific displacing velocity using Franklin's equation and predicting a recovery of the oil from the reservoir using the residual oil saturation in a computational model of the reservoir. Some systems and methods also include pumping a displacing fluid into the reservoir to cause the recovery of the oil from the reservoir, where Franklin's equation's is based on a mass density of the displacing fluid.

Some systems and methods include one or more of the following features.

In some systems and methods, the location-specific displacing velocity represents a velocity of an interface between the oil and a displacing fluid within the reservoir. In some cases, the displacing fluid is water. In some cases, the methods include pumping the displacing fluid into the reservoir to cause the recovery of the oil from the reservoir.

In some systems and methods, determining the location-specific displacing velocity of the reservoir includes evaluating the following equation: nu=c*k*mu^(−2), where nu is the location-specific displacing velocity, c is a constant, k is the location-specific permeability of the reservoir, and mu is the fluid viscosity of the oil. In some cases, the methods include determining c based on experimental data. In some cases, an initial value of c is 0.016. In some cases, the methods include adjusting the initial value of c to a different value based on experimental data.

Some systems and methods include predicting the recovery of the oil from the reservoir using the residual oil saturation in the computational model of the reservoir comprises plotting the residual oil saturation as a function of a depth in a wellbore located within the reservoir.

In some systems and methods, predicting the recovery of the oil from the reservoir using the residual oil saturation in the computational model of the reservoir includes using both a static computational model and a dynamic computational model to predict the recovery of the oil from the reservoir.

In some systems and methods, predicting the recovery of the oil from the reservoir accounts for an injection efficiency of the reservoir.

Some systems and methods include estimating a fluid viscosity of the oil in the reservoir and estimating a location-specific permeability of the reservoir across the reservoir. In some cases, determining the location-specific displacing velocity of the reservoir includes evaluating the following equation: nu=c*k*mu^(−2), where nu is the location-specific displacing velocity, c is a constant, k is the location-specific permeability of the reservoir, and mu is the fluid viscosity of the oil. In some cases, predicting the recovery of the oil from the reservoir using the residual oil saturation in the computational model of the reservoir includes using both a static computational model and a dynamic computational model to predict the recovery of the oil from the reservoir. In some cases, the static computational model is used to determine the residual oil saturation in one or more grid cells of the static computational model. In some cases, the static computation model does not account for a rate and a pressure variation of the oil. In some cases, the dynamic computational model is used to predict the recovery of the oil from the reservoir based on the residual oil saturation from the static computational model. In some cases, the dynamic computation model accounts for the rate and the pressure variation of the oil.

Some systems and methods include estimating an interfacial tension between the displacing fluid and the oil and using the interfacial tension in Franklin's equation. In some cases, estimating the interfacial tension includes estimating the interfacial tension using Ramey's correlation.

In some systems and methods, determining the residual oil saturation of the reservoir is based on a wettability angle and the wettability angle is between 30° and 65°.

In some systems and methods, the residual oil saturation depends on a depth of the reservoir.

The systems and methods described in this specification can provide various advantages.

The systems and method described in this specification use a limited amount of field and/or lab data to determine residual oil saturation. For example, only the permeability of the reservoir and either the fluid viscosity of an oil of the reservoir or a mass density of the oil of the reservoir is needed to determine the residual oil saturation of the reservoir. The remaining parameters are either constant (e.g., gravitational constant), determined as a function of permeability, oil viscosity, and oil density, or determined using a curve fit. This allows the residual oil saturation to be determined in reservoirs where data is difficult to obtain and/or is otherwise unknown (e.g., when limited rock and/or fluid data is known).

The systems and methods described in this specification determine the residual oil saturation of the reservoir based a new formula that accounts for the differential pressure of the reservoir. For example, velocity is related to pressure in accordance with fluid mechanics principles. Displacing velocity is not measured or estimated during lab experiments so it is not possible to relate the displacing velocity to differential pressure. The equations, and in particularly, Eq. 7 of this specification, are more accurate than existing approaches because the equations of this specification implicitly account for the differential pressure of the reservoir. In some examples, the displacing velocity is used as a calibration factor in this specification because Franklin's equation does not otherwise account for the differential pressure.

The systems and methods described in this specification predict the residual oil saturation of a reservoir more conservatively than existing methods. In some examples, this means that engineers can select a drill site based on reservoir data that and be more confident that a large amount of oil will be recovered from the reservoir.

The details of one or more embodiments of these systems and methods are set forth in the accompanying drawings and the description below. Other features, objects, and advantages of these systems and methods will be apparent from the description and drawings, and from the claims.

DETAILED DESCRIPTION

The systems and methods described in this specification relate to determining residual oil saturation of a reservoir. The systems and method described in this specification determine displacing velocity as a function of permeability of the reservoir and the viscosity of an oil of the reservoir. This approach allows the displacing velocity to vary throughout the reservoir which improves the accuracy of the residual oil saturation values. This new approach with displacing velocity is used in combination with Franklin's equation to determine residual oil saturation that is more accurate (and more conservative) that historical methods. The resulting residual oil saturation values are used in computational models to predict a recovery of the oil from the reservoir. In some examples, the recovery is used to identify drilling sites, estimate reservoir reserves and to determine EOR of the reservoir.

Figure 1:
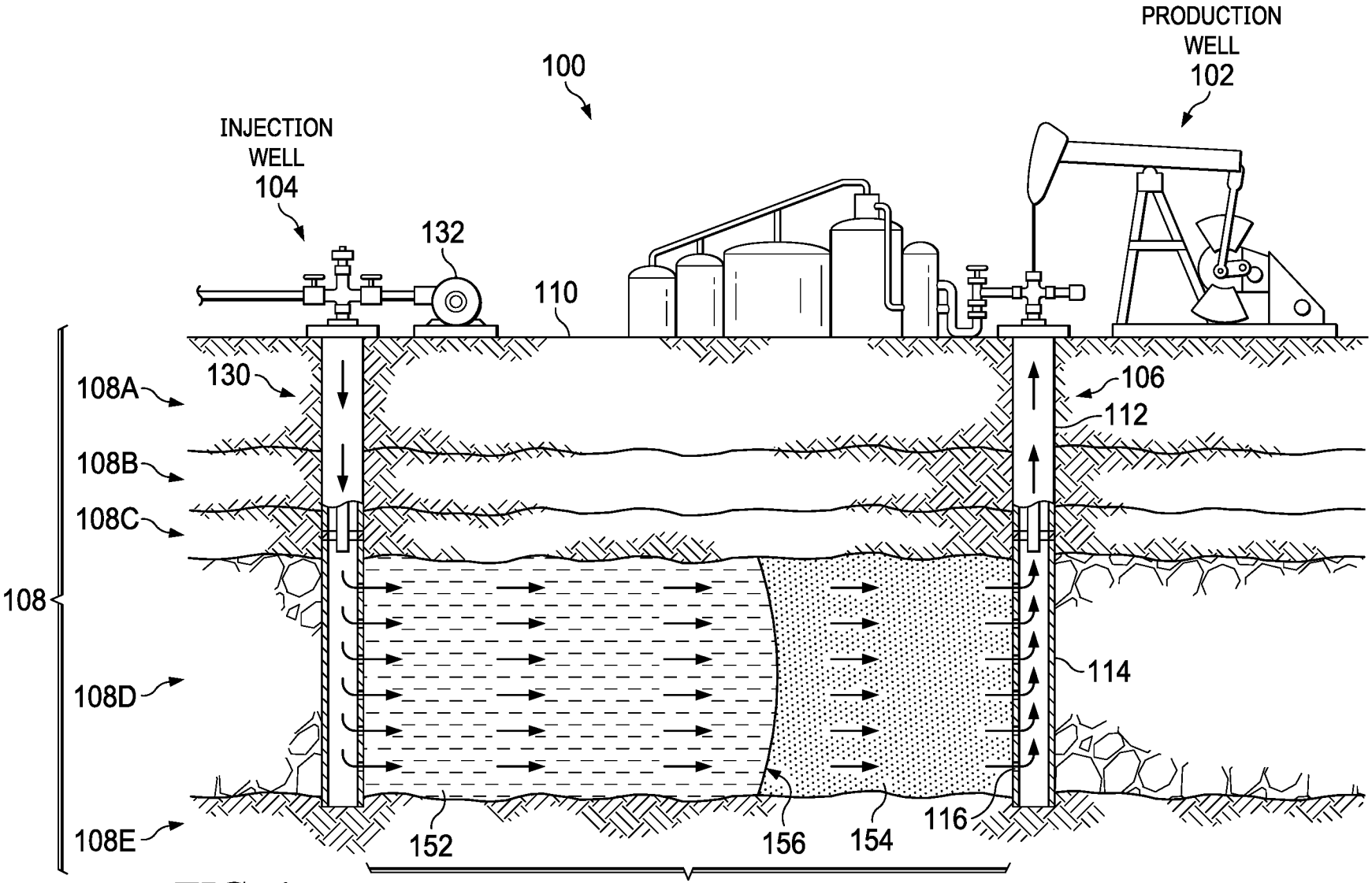
FIG. 1 is a schematic diagram of an example wellbore system.

FIG. 1 is a schematic diagram of wellbore system 100 that includes a production well 102 and an injection well 104. The production well 102 includes a vertical wellbore 106 formed into a subterranean formation 108. In some examples, the wellbore 106 is formed by drilling into one or more layers of the subterranean formation 108. In this example, the wellbore 106 extends through four layers 108A-D and lands in subterranean layer 108E. In this example, a reservoir 150 of hydrocarbon 154 (e.g., oil) is located within subterranean layer 108D. The reservoir 150 includes porous shale rock with pores that contain the hydrocarbon 154 and/or sandstone with the hydrocarbon 154 located between the grains of the sandstone.

The production well 102 includes a production casing 114 formed downhole of a surface casing 112. In some examples, both the surface casing 112 and the production casing 114 are formed and set within the wellbore 106 by pouring cement between each respective casing 112, 114, and the subterranean layers 108A-E. The production casing 114 includes one or more perforations 116 that allow the hydrocarbon 152 to flow from the reservoir 150 into the wellbore 106 and up to the ground surface 110.

The injection well 104 includes a wellbore 130 that is the same as the wellbore 106 of the production well 102 except for the following differences. The injection well 104 includes a pump 132 that pumps a displacing fluid 152 (e.g., water) into the reservoir 150. In some examples, the injection of the fluid 152 increases a recovery of the hydrocarbon 154 from the reservoir 150 because the fluid 152 forces the hydrocarbon 154 through the porous shale and sandstone rock to the production well 102. The region where the fluid 152 and the hydrocarbon 154 interact is represented by region 156. In some examples, the process of injecting water 154 into the reservoir 150 for this purpose is referred to as "waterflooding."

Eventually the amount of energy and time needed to recover the hydrocarbon 154 from the reservoir 150 becomes prohibitive. Oftentimes the recovery of any remaining hydrocarbon is abandoned at this point. This remaining hydrocarbon is referred to as "residual hydrocarbon." In some examples, residual hydrocarbon is hydrocarbon 154 that is trapped within the pores of the shale and/or within the space of the grains of the sandstone.

The "residual oil saturation" ($S_{OR}$) is another term of interest that is defined as the ratio of a volume of the residual hydrocarbon divided by the effective porosity of the rock (e.g., the shale or sandstone). A reservoir with a low residual oil saturation (e.g., less than 50%) is preferable over a reservoir with a high residual oil saturation (e.g., greater than 50%).

Determining the residual oil saturation of the reservoir 150 is important because the residual oil saturation indicates of how much hydrocarbon 154 is recoverable from the reservoir 150 when a particular displacing fluid 152 is used. However, determining the residual oil saturation is difficult because of a dependency on the particular displacing fluid, and in particular, a displacing velocity which represents the velocity of a wave-front of the hydrocarbon-fluid interface through the reservoir 150.

Figure 2A:
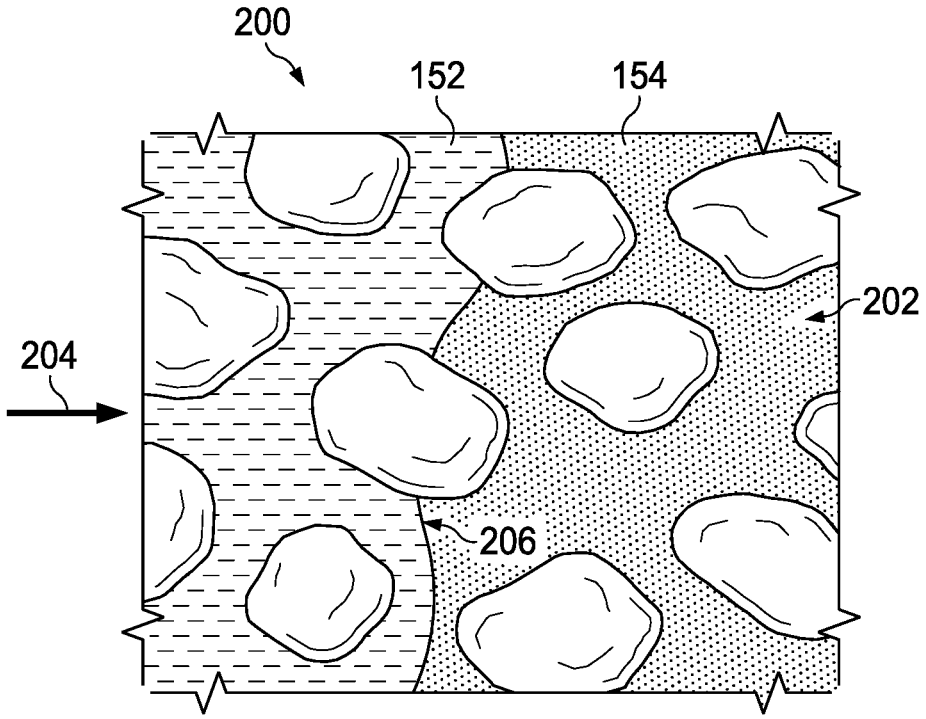
FIG. 2A is a schematic view of a hydrocarbon-fluid interface within a porous rock of the reservoir of the wellbore system shown in FIG. 1.

FIG. 2A is a schematic view of hydrocarbon flowing through a porous rock 200 of the reservoir 150. As noted above, in some examples, the porous rock 200 is shale and/or sandstone. The porous rock 200 includes a microstructure with one or more pores 202 (generally represented in FIG. 2A as the space where the displacing fluid 152 and hydrocarbon 154 flow). During a waterflooding operation, the displacing fluid 152 flows through the porous rock 200 in the direction represented by arrow 204. The interface 206 between the fluid 152 and the hydrocarbon 154 forms a wave-front that propagates through the porous rock 200 in the direction represented by the arrow 204. The displacing velocity represents the velocity of the wave-front 206 through the reservoir 150.

Figure 2B:
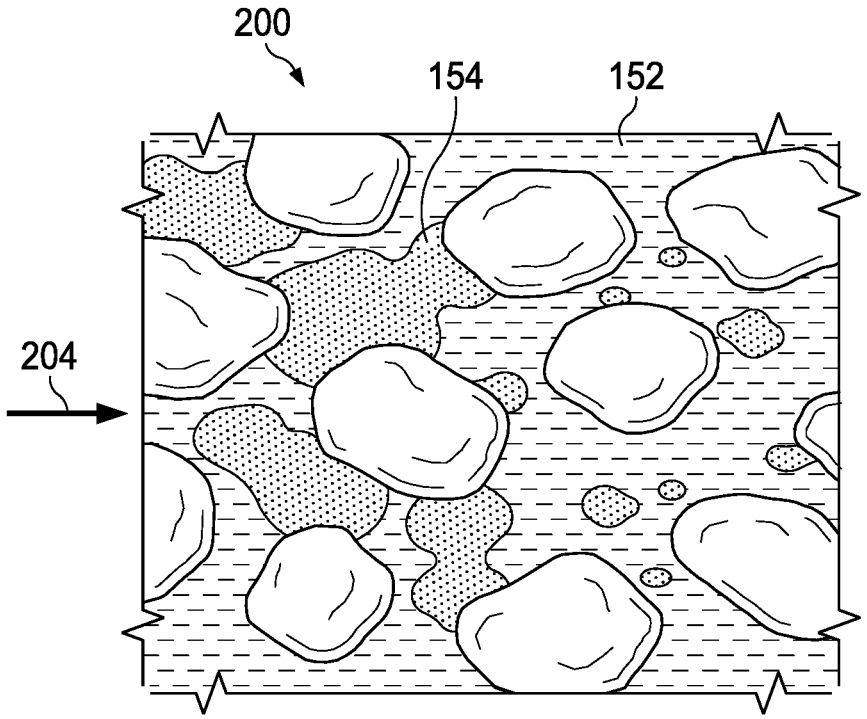
FIG. 2B is an image of residual hydrocarbon within the porous rock shown in FIG. 2A.

FIG. 2B is an image of residual hydrocarbon 154 within the porous rock 200. In some examples, the residual hydrocarbon 154 is trapped within the pores of the porous rock 200. For example, the residual hydrocarbon 154 does not move even when displacing fluid 152 is continuously pumped into the reservoir 150. The amount of hydrocarbon remaining in the reservoir 150 after the displacing fluid 152 has been pumped into the reservoir 150 for a theoretically infinite amount of time defines the residual oil saturation percentage of the reservoir 150.

Parameters that affect the residual oil saturation of the reservoir 150 include: a viscosity of the fluid 152, $\mu$; a velocity of the hydrocarbon-fluid interface 206, $\tau$; an interfacial tension of the hydrocarbon-fluid interface 206, $\sigma$; a mass density difference between the fluid (w) and the hydrocarbon (o), $\Delta\rho=\rho_w-\rho_o$; a permeability of the rock 200 of the reservoir 150, k; a wettability angle of the rock 200 of the reservoir 150, $\theta$; and a gravitational constant, g.

In some examples, the residual oil saturation of the reservoir 150 spatially-varies throughout the reservoir 150. For example, the residual oil saturation can be 10% in some regions of the reservoir 150 and 50% in other regions of the reservoir 150. In some examples, the residual oil saturation varies as a function of a depth in the wellbore 106. This can be caused by, for example, changes in differential pressure throughout the reservoir 150 which causes a change in displacing velocity of the wave-front 206. A change in displacing velocity will change the residual oil saturation.

Franklin's equation is a way to determine the residual oil saturation of the reservoir 150. Franklin's equation is defined as:

$$Sor = 0.02 + 0.0505\log\left(\frac{0.01227}{Nc + 0.5NB}\right) \quad (1)$$

where Sor is the residual oil saturation, Nc the capillary number, NB is the Bond number, and log(*) is the base-10 logarithm. The capillary and Bond numbers are defined as:

$$Nc = \frac{\mu\upsilon}{\sigma\cos\theta} \quad (2)$$

$$NB = \frac{\Delta\rho g k}{\sigma} \quad (3)$$

where μ, υ, σ, Δρ, k, θ, and g were defined above. Franklin's equation (Eq. 1) is a function of the capillary Number (Eq. 2) and the Bond number (Eq. 3). Table 1 shows example dimensions and a short description for each of these parameters. It is important to use consistent units (e.g., g/cc for interfacial tension calculation and kg/m$^3$ for the Bond number).

TABLE 1

Parameters for the Franklin Equation (Eq. 1)

| # | Parameter | Dimension | Description |
|---|---|---|---|
| 1 | Sor | Dimensionless | Residual Oil Saturation |
| 2 | Nc | Dimensionless | Capillary number |
| 3 | NB | Dimensionless | Bond Number |
| 4 | μ | Pa.sec (Kg/m.sec) | Fluid viscosity (1 cp = 0.001 Pa.sec) |
| 5 | υ | m/sec | Displacing velocity (m/sec = ft/day/283464.57 ) |
| 6 | σ | N/m | Interfacial tension (N/m = dyne/cm*0.001) |
| 7 | θ | Radian | Wettability angle (Radian = degree*π/180) |
| 8 | Δρ | Kg/m$^3$ | Mass density difference (Kg/m$^3$ = g/cc*1000) |
| 9 | g | m/sec$^2$ | Gravitational force (9.80665 m/sec$^2$) |
| 10 | k | m$^2$ | Permeability (m$^2$ = mD*9.869232667*10^−16) |

One aspect that limits Franklin's equation's (Eq. 1) wide use in practice is that Eq. 1 requires many parameters that are generally unknown and require lab and/or field experiments to determine. The systems and methods described in this specification derive these unknown parameters of Eq. 1 using new correlations instead of lab and/or field experiments. This is beneficial in situations where limited field data is available and in hydrocarbon fields where heavy oil exists or has properties that make conducting experiments unfeasible (e.g., high temperatures, deep wells, etc). For example, sometimes experiments are unfeasible because of poor lab conditions, insufficient capacity, and/or burdensome testing protocols for each experiment. In some cases, labs are limited to 1,500 psi and/or 10,000 rpm (e.g., depending on the type of experiment such as USS, SS, centrifuge, etc.). In some cases, lab experiments are unfeasible when oil have a viscosity >100 cp and/or a permeability <5-20 md. However, in other cases, lab experiments are unfeasible when oil has a viscosity of less 100 cp and/or rocks have a permeability higher than 20 md.

Importantly, Franklin's equation (Eq. 1) requires the displacing velocity to be known. However, this is very difficult in practice to determine and approximate. The systems and methods described in this specification use an alternative approach to determine the displacing velocity that does not require lab experiments while still account for the spatial variation of the displacing velocity throughout the reservoir. This method is described below with reference to FIG. 3.

Figure 3:
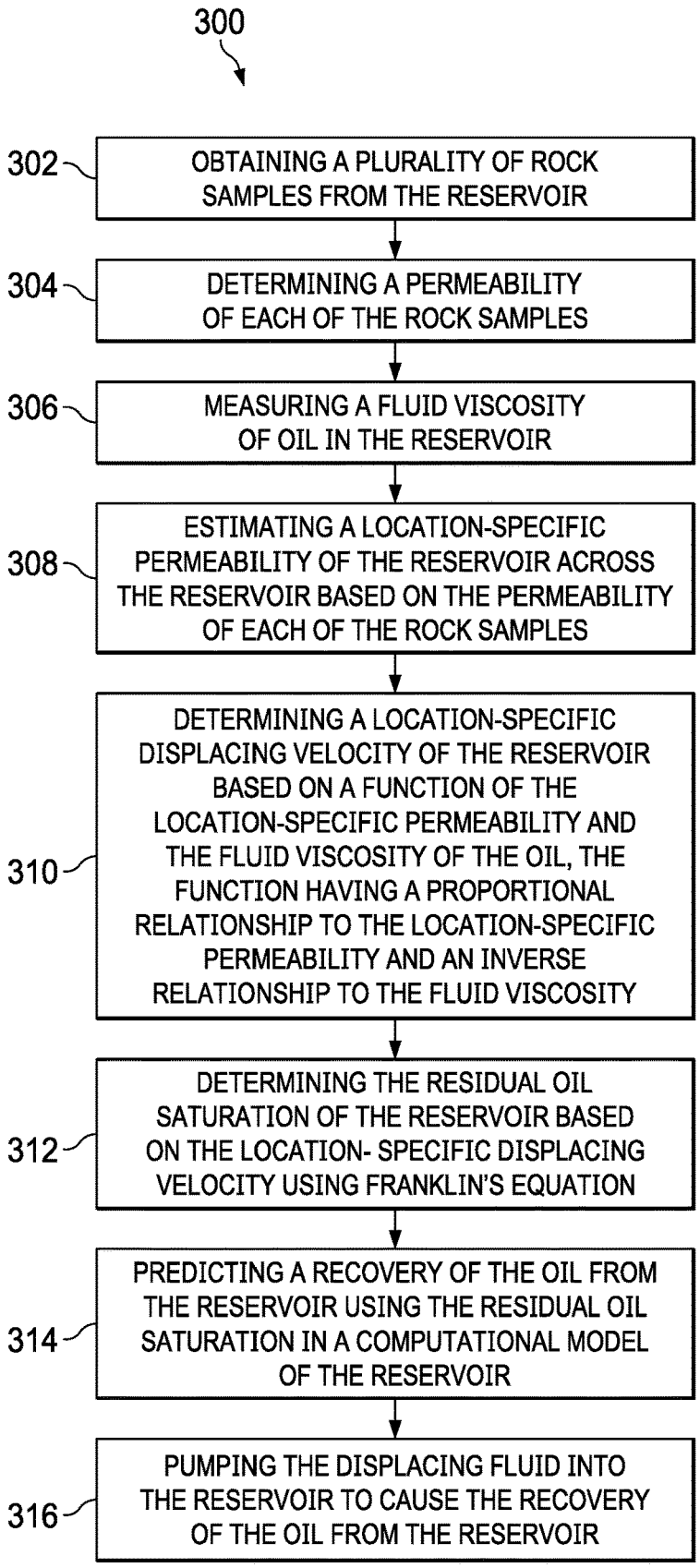
FIG. 3 is a flowchart of an example method for determining residual oil saturation throughout the reservoir of the wellbore system shown in FIG. 1.

FIG. 3 is a flowchart of an example method 300 to calculate residual oil saturation of a reservoir using Franklin's equation (Eq. 1). As used throughout this specification, a "location-specific" property means that the property depends on a location throughout the reservoir (e.g., the property is generally not constant throughout the reservoir).

At step 302, the method includes obtaining a plurality of rock samples from the reservoir 150. In some examples, an engineer obtains the rock samples from core samples obtained from the reservoir 150 at various locations (e.g., depths and horizontal directions) of the reservoir 150.

At step 304, the method includes determining a permeability of each of the rock samples. In some examples, an engineer measures the permeability. In some examples, an engineer measures the permeability by drying the rock samples an oven to remove any residual fluids within the rock samples and causing air to flow through the rock samples. In some cases, an engineer uses Darcy's law to determine the permeability of each of the rock samples. In some examples, determining the permeability of each of the rock samples includes using a tri-axial pressure test to determine the permeability.

At step 306, the method includes measuring a fluid viscosity of oil in the reservoir 150. In some examples, an engineer measures the fluid viscosity of the oil using kinematic viscometer. In some examples, an engineer estimates the fluid viscosity of the oil. In some examples, an engineer measures a mass density of the oil in the reservoir 150 instead of the fluid viscosity. In some examples, the mass density of the oil, ρ, is determined using ρ=m/V where m is the mass of the oil and V is the volume of the oil.

In some examples, step 306 includes determining the fluid viscosity of the oil based on the oil mass density, or vice versa. In some examples, this determination is performed based on experimental data from a pressure volume temperature (PVT) experiment, where the experimental data is collected within a wellbore through the reservoir 150. In some examples, a nuclear magnetic resonance (NMR) experiment is used to estimate the oil mass density.

In some examples, determining the oil viscosity based on the oil mass density (or vice versa) is performed using Abu-Khamsin and Al-Marhoun's correlation:

$$\ln(\mu_{ob}) = -2.652294 + 8.484462(\rho_{ob})^4 \quad (4)$$

where "ln" is the natural logarithm, $\mu_{ob}$ is the oil viscosity at the bubble point pressure, and $\rho_{ob}$ is the oil mass density at the bubble point pressure. In some examples, the bubble point pressure represents the pressure at which the first bubble of rises out of the oil. In some examples, the method involves calibrating Abu-Khamsin and Al-Marhoun's correlation based on PVT experimental data.

At step 308, the method includes estimating a location-specific permeability of the reservoir 150 across the reservoir 150 based on the permeability of each of the rock samples. In some examples, an engineer interpolates the permeability of each of the rock samples based on a location within the reservoir 150 where each rock sample was extracted. In some examples, the location-specific permeability of the reservoir 150 spans the entire reservoir 150 defined by a boundary associated of the locations of all of the rock samples.

At this point in this method, the location-specific permeability of the reservoir 150, and either the fluid viscosity or the mass density of the oil is known.

At step 310, the method includes determining a location-specific displacing velocity of the reservoir 150 based on a function of the location-specific permeability and the fluid viscosity of the oil. As noted above, the displacing velocity represents a velocity of the interface between the displacing fluid and the oil. In some examples, this interface is a wave-front during a waterflooding operation. In some examples, the displacing velocity is the most uncertain parameter in Franklin's equation (Eq. 1) because the displacing velocity is difficult to measure and/or approximate. In some examples, an engineer assumes a constant displacing velocity of 1 ft/day (e.g., the interface between the displacing fluid and the oil moves through the reservoir at 1 foot per day) in order to avoid having to determine the displacing velocity. However, assuming a constant displacing velocity leads to unphysical residual oil saturation predictions. These predictions are shown in FIG. 6 below.

Figure 6:
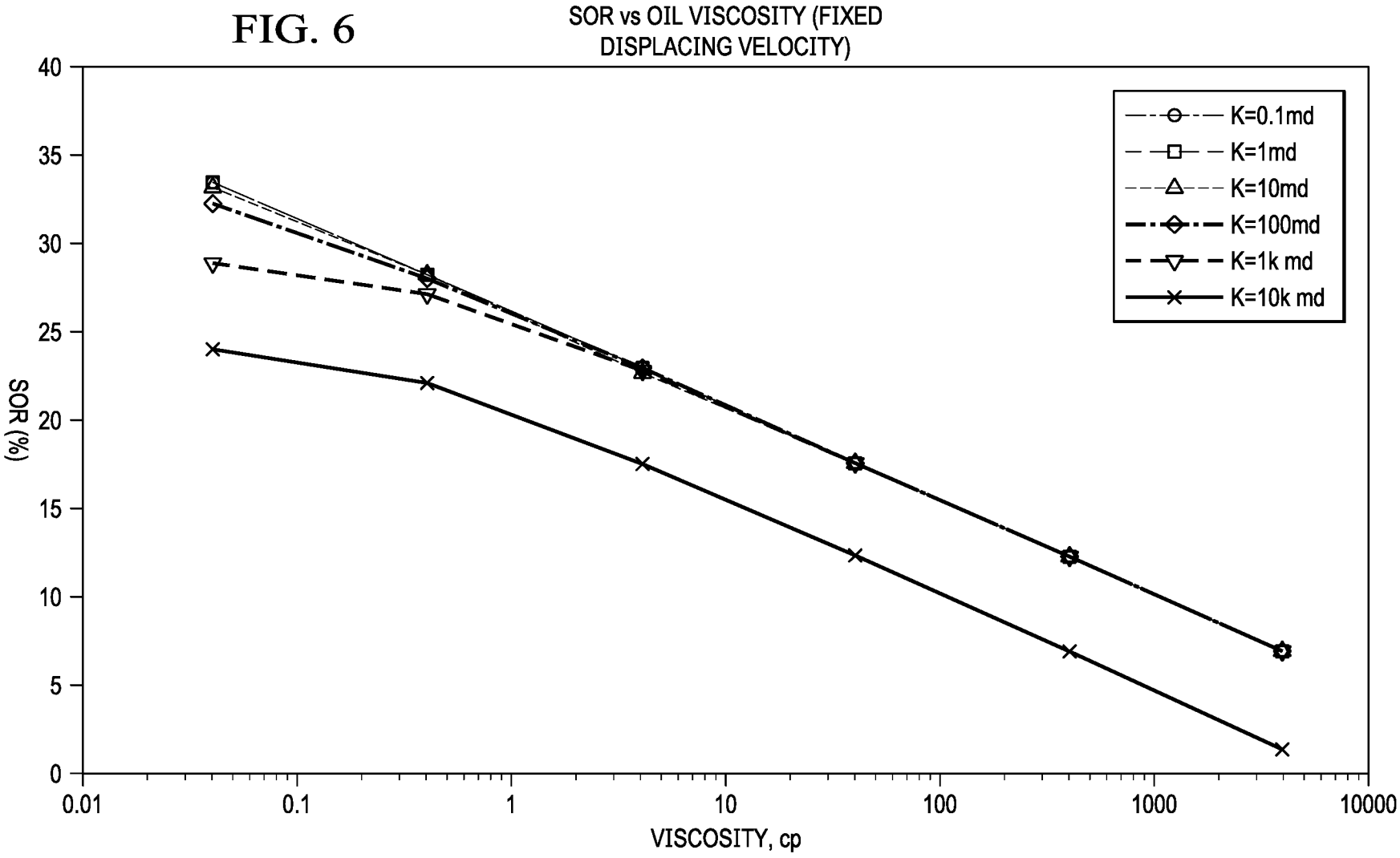
FIG. 6 is a plot of the residual oil saturation of the reservoir of the wellbore system shown in FIG. 1 as a function of viscosity and permeability of the reservoir assuming a fixed displacing velocity of 1 ft/day throughout the reservoir.

FIG. 6 is a plot of the residual oil saturation predictions of the reservoir as a function of viscosity and permeability assuming a constant displacing velocity of 1 ft/day throughout the reservoir. The residual oil saturation predictions are determined based on Franklin's equation (Eq. 1). K represents the location-specific permeability of the reservoir. As shown in FIG. 6, the residual oil saturation prediction decreases as viscosity increases. This behavior is not consistent with physical reality. In extreme cases, engineers do not use Franklin's equation (Eq. 1) to determine residual oil saturation because of this unphysical behavior. In some examples, the displacing velocity is measured using a lab experiment but these experiments are difficult to conduct, expensive, and time consuming.

The systems and methods described in this specification use an alternative approach to determine the displacing velocity that does not require lab experiments but also accounts for the spatial variation of the displacing velocity throughout the reservoir. In some examples, the displacing velocity is determined based on the following equation:

$$\upsilon = C*k*\mu^{-2} \tag{5}$$

where $\upsilon$ is the displacing velocity, C is a calibration constant, k is the location-specific permeability of the reservoir, and $\mu$ is the fluid viscosity of the oil. The displacing velocity, in accordance with Eq. 5, has a proportional relationship with the location-specific permeability and an inverse relationship with the fluid viscosity of the oil. In some examples, an engineer determines (e.g., estimates) the location-specific displacing velocity of the reservoir as a function of the permeability of the rock of the reservoir and the fluid viscosity of the oil within the reservoirs using Eq. 5. The engineer uses the determined location-specific displacing velocity in Franklin's equation (Eq. 1) to predict the residual oil saturation of the reservoir throughout the reservoir. Unlike the case above where a constant displacing velocity was assumed, using a location-specific displacing velocity leads to a physical residual oil saturation prediction of the reservoir. These predictions are shown in FIG. 7 below.

Figure 5:
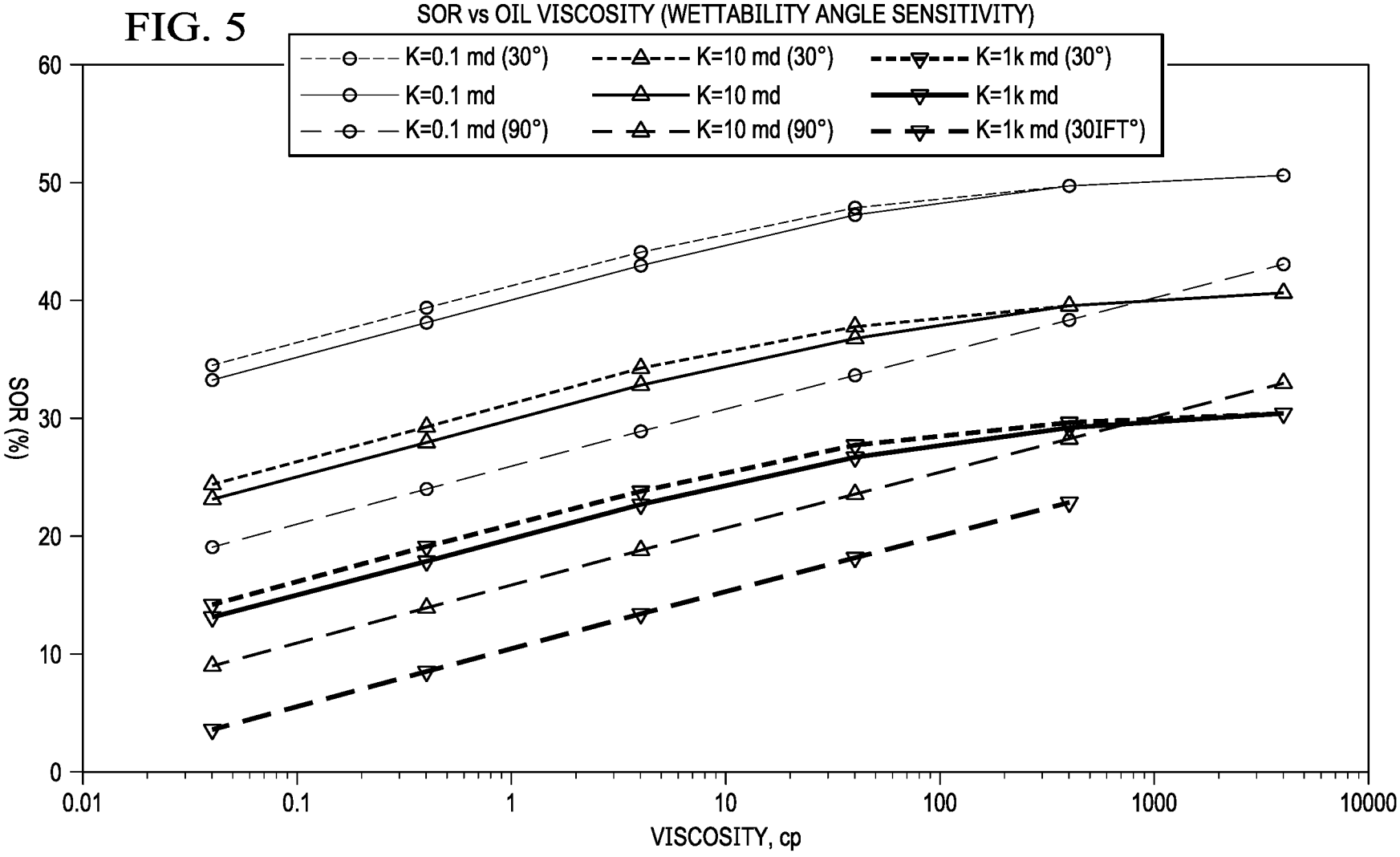
FIG. 5 is a plot of the residual oil saturation of the reservoir of the wellbore system shown in FIG. 1 illustrating a dependency on wettability angle of an interface between the displacing fluid and the oil within the reservoir.
Figure 7:
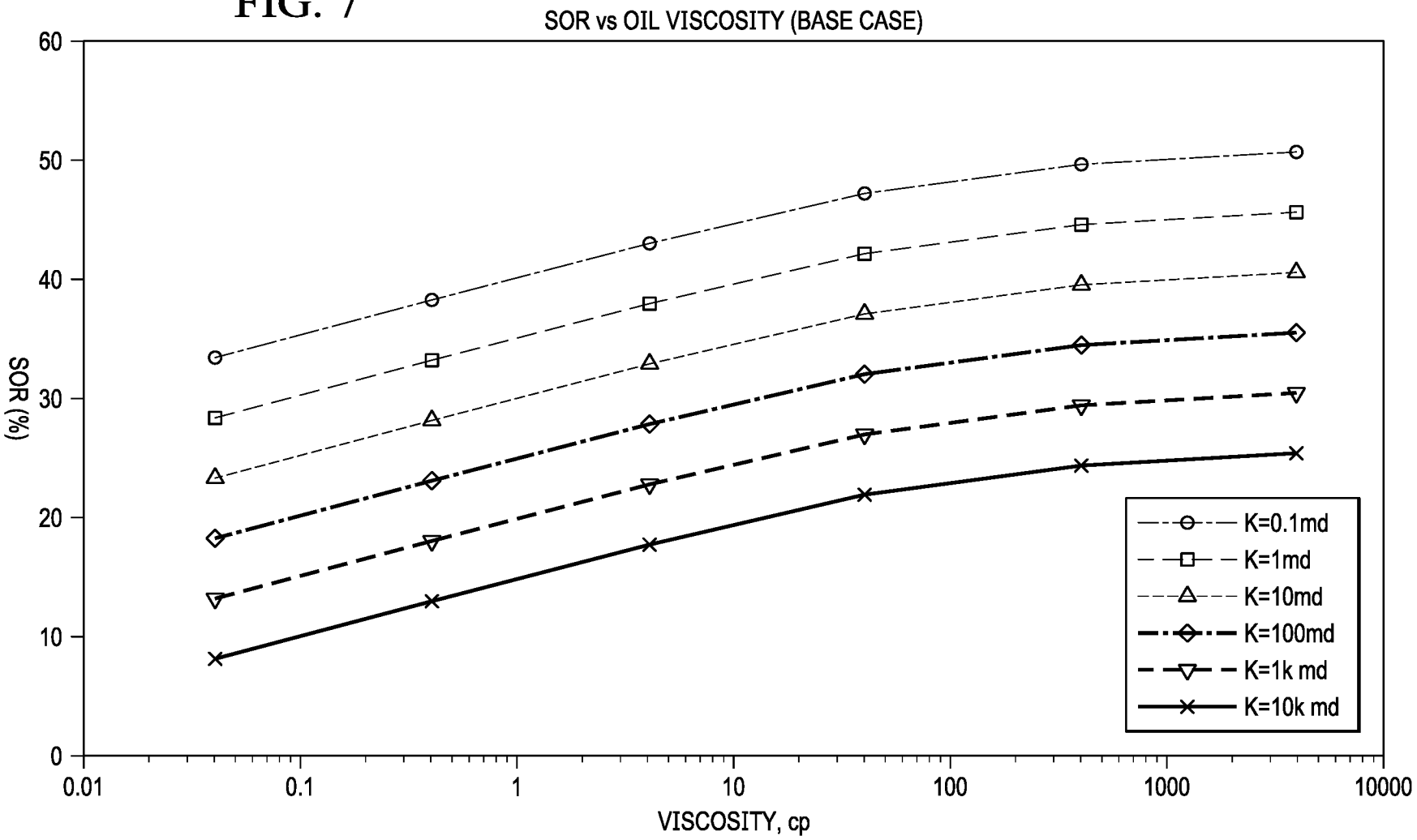
FIG. 7 is a plot of the residual oil saturation of the reservoir of the wellbore system shown in FIG. 1 as a function of viscosity and permeability of the reservoir assuming a location-specific displacing velocity throughout the reservoir.

FIG. 7 is a plot of the residual oil saturation of the reservoir as a function of viscosity and permeability of the reservoir assuming a location-specific displacing velocity throughout the reservoir. K represents the location-specific permeability of the reservoir. In this example, the residual oil saturation prediction increases as the viscosity increases. This is a physical correlation between the residual oil saturation and viscosity. The results shown in FIG. 5 represent a base case with $\sigma^{\circ}=15$, a wettability angle of 60°, and a calibration constant C=0.016. Franklin's equation (Eq. 1) accounts for the mass density of the displacing fluid because the interfacial tension (described below) depends on the mass density difference which is a function of the mass density of the displacing fluid.

As noted above, the calibration constant C is a calibration constant (e.g., a fitting parameter). The particular value of C=0.016 was found to be a good initial approximation when calculating Sor because the resulting Sor was found to agree well with Sor results from existing published and unpublished data sets.

In some examples, a range of the calibration constant C is determined (e.g. between 0 and 0.05). In some examples, the calibration constant C and/or a range of the calibration constant C are determined based on experimental data. In some examples, the calibration constant C is determined using data representing a 1 Darcy, 0.4 cp, and 17% Sor data set. In this example, the values of 1 Darcy, 0.4 cp, and 17% Sor are averages of published and unpublished data sets. In this example, these values are held constant in order to understand the effect of changing one other parameter (e.g., $\sigma$, wettability angle, etc.) at a time within the Sor calculation according to Franklin's equation (Eq. 1). As noted above, Franklin's equation (Eq. 1) is used to determine the Sor based on particular rock and fluid properties.

In some examples, the calibration constant C is initially set to 0.016 and then adjusted to determine the best fit (e.g., according to a least squares fit). Since the displacing velocity is a function of the calibration constant C, changing the calibration constant C leads to a chance in the displacing velocity which leads to a change in the residual oil saturation prediction.

At step 314, the method includes determining the residual oil saturation of the reservoir based on the location-specific displacing velocity using Franklin's equation (Eq. 1). In some examples, the location-specific displacing velocity is computed using Eq. 5 described above.

In some examples, determining the residual oil saturation of the reservoir includes determining the capillary number and the Bond number based on Eqs. 2 and 3, respectively. In some examples, determining the capillary number includes calculating the mass density difference between the displacing fluid (e.g., water) and the oil based on the following equation:

$$\Delta\rho = \rho_w - \rho_o \tag{6}$$

where $\Delta\rho$ is the mass density difference, $\rho_w$ is the mass density of the displacing fluid, and $\rho_o$ is the mass density of the oil. In this example, $\Delta\rho$ is used in Eq. 2 to determine the capillary number Nc and the capillary number Nc is used in Franklin's equation (Eq. 1) to determine the residual oil saturation of the reservoir.

In some examples, determining the residual oil saturation of the reservoir includes calculating the interfacial tension, $\sigma$. In some examples, calculating the interfacial tension is performed using Ramey's correlation. Ramey's correlation is generally reliable because it is applicable to a wide range of oil and water properties. Ramey's correlation uses units of dyne/cm and is a function of the density difference $\Delta\rho$ (in units of g/cc). Ramey's correlation is:

$$\sigma=\sigma^{\circ}+(72-\sigma^{\circ})*\Delta\rho \quad (7)$$

where $\sigma^{\circ}=15$. In some examples, values other than $\sigma^{\circ}=15$ are used. In some examples, $\sigma^{\circ}$ is determined by calibration (e.g., by varying $\sigma^{\circ}$). In some examples, an engineer estimates the interfacial tension between the displacing fluid and the oil.

Figure 4:
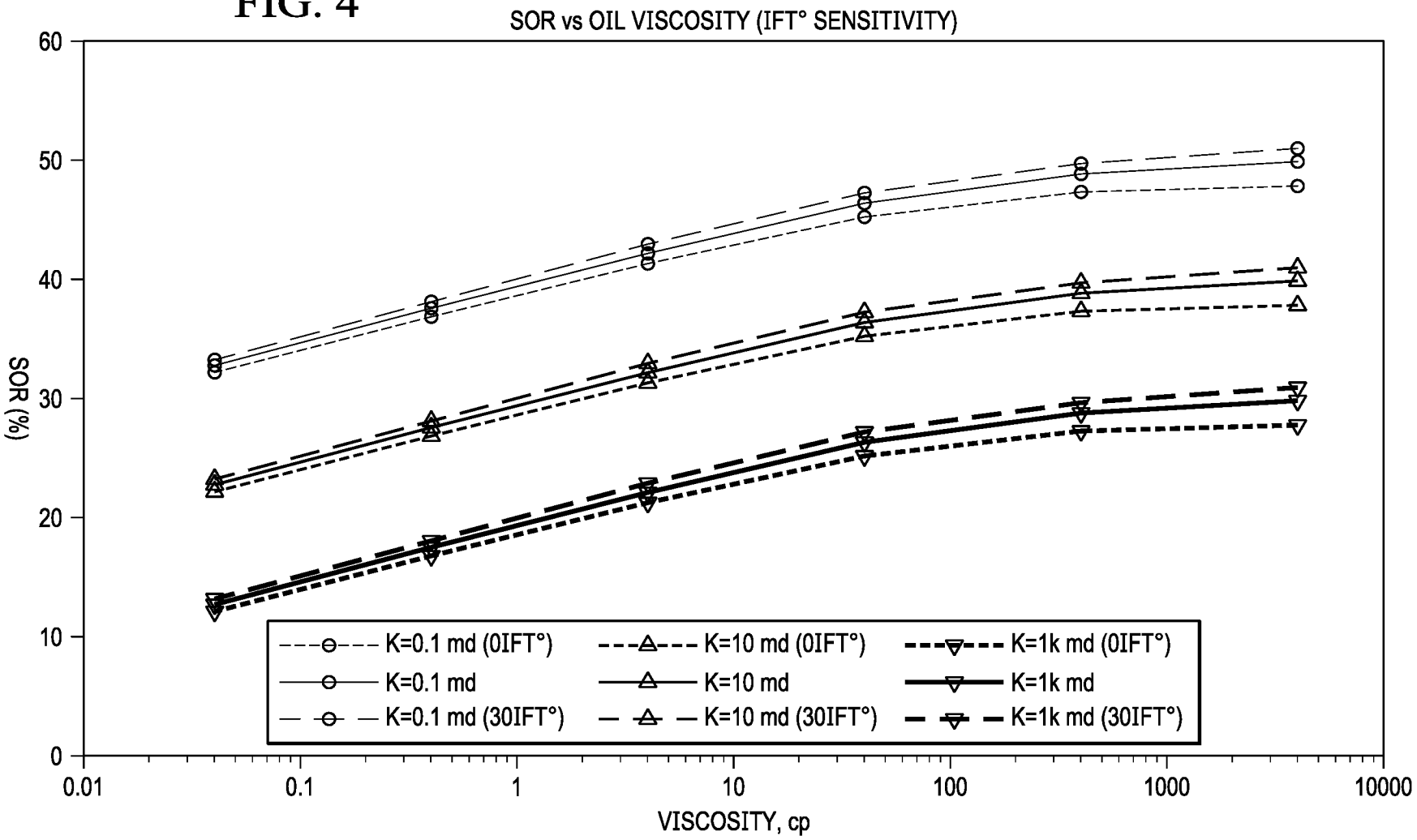
FIG. 4 is a plot of the residual oil saturation of the reservoir of the wellbore system shown in FIG. 1 illustrating a dependency on an interfacial tension calibration factor.

FIG. 4 is a plot of the residual oil saturation (Sor) of the reservoir illustrating a dependency on the interfacial tension calibration parameter $\sigma^{\circ}$ of the reservoir. The baseline results (solid line) represent $\sigma^{\circ}=15$, the $\sigma^{\circ}=0$ results are represented by a dotted line, and the $\sigma^{\circ}=30$ results are represented by a dashed line. K represents the permeability of the reservoir. The results shown in FIG. 4 indicate that $\sigma^{\circ}$ does not have a strong effect on the residual oil saturation predictions. Increasing/decreasing the permeability K has a much stronger effect. In this example, $\sigma^{\circ}$ is used in Franklin's equation (Eq. 1) to determine the residual oil saturation of the reservoir. In this example, $\sigma$ is used in Eqs. 2 and 3 to determine the capillary number Nc and the Bond number NB, respectively. Both the capillary number Nc and the Bond number NB are used in Franklin's equation (Eq. 1) to determine the residual oil saturation of the reservoir.

In some examples, determining the residual oil saturation of the reservoir includes calculating a wettability angle. In some examples, a wettability angle of 60° is a reasonable estimate for imbibition within a water-oil reservoir. In some examples, a constant wettability angle is used even if the fluid properties of the water and/or oil are location-specific. In some cases, the wettability angle is between 30° and 60°. For example, in most cases, a varying wettability angle between 30° to 65° does not have a strong effect on the residual oil prediction.

FIG. 5 is a plot of the residual oil saturation of the reservoir illustrating a dependency on wettability angle of the reservoir. The baseline results (solid line) represent a wettability angle of 60°, the results with a wettability angle of 30° are represented by a dotted line, and the results with a wettability angle of 90° are represented by a dashed line. K represents permeability of the reservoir. The results shown in FIG. 5 indicate that varying the wettability angle between 30° and 65° does not have a strong effect on the residual oil saturation predictions. However, varying the wettability angle between 65° and 90° does have a considerable effect on the residual oil saturation predictions. In some examples, the rock of the reservoir has a strong water-oil mixture wettability when the wettability angle is about 65° and the rock becomes a strongly oil wet rock when the wettability angle is about 90°. This increase of oil wettability leads to a high residual oil saturation. As shown in FIG. 5, the residual oil saturation prediction decreases the wettability angle increases to 90°. In this example, the wettability angle $\theta$ is used in Eq. 2 to determine the capillary number Nc and the capillary number Nc is used in Franklin's equation (Eq. 1) to determine the residual oil saturation of the reservoir.

In some examples, determining the capillary number and the Bond number includes plotting the capillary number and the Bond number as a function of oil viscosity to visualize whether the capillary number and Bond numbers have physical behavior. In some examples, physical behavior is when the capillary number varies as a function of oil viscosity and the Bond number is constant as a function of oil viscosity. A small variation (e.g., within an order of magnitude) in Bond number as the oil viscosity increases is generally acceptable. This physical behavior is shown in FIG. 8.

Figure 8:
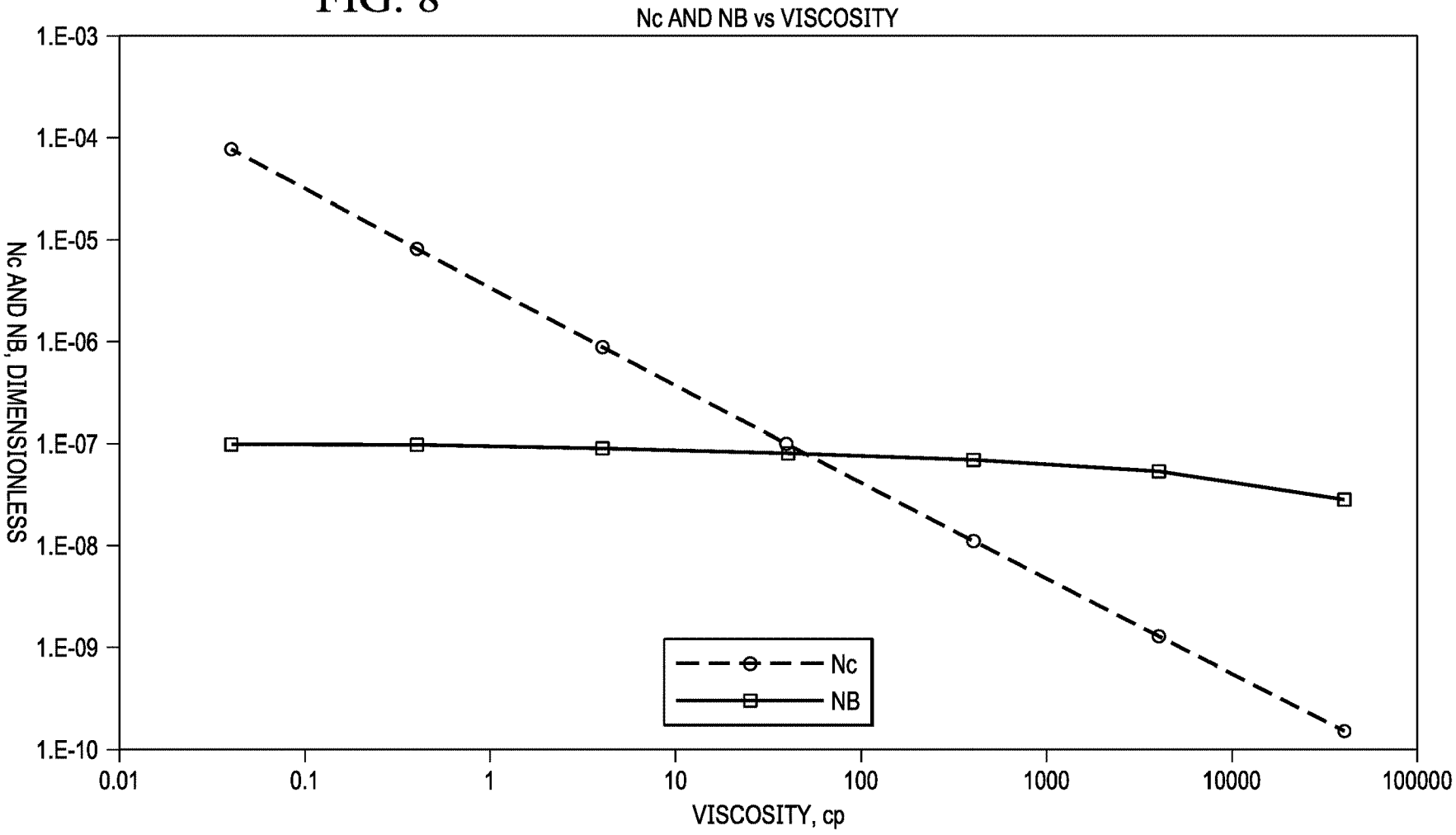
FIG. 8 is a plot of the capillary number and the Bond number as a function of viscosity.

FIG. 8 is a plot of the capillary number and the Bond number as a function of oil viscosity. The results reveal a physical behavior of the capillary number and Bond numbers as described above. In most cases, capillary forces have a significant effect during waterflooding causing the residual oil saturation prediction to be more sensitive to the capillary number than the Bond number.

At step 312, the method includes determining the residual oil saturation of the reservoir 150 based on the location-specific displacing velocity using Franklin's equation (Eq. 1) based on all the parameters described in Table 1 above. For example, once each parameter of Eqs. 2 and 3 are determined using the method described above (or otherwise known), the residual oil saturation of the reservoir is determined using Franklin's equation (Eq. 1).

In some examples, determining the residual oil saturation of the reservoir 150 includes plotting the residual oil saturation as a function of the oil viscosity for different permeability values as shown in FIG. 7. In some examples, the results shown in FIG. 7 is used for quality check purposes. For example, if there are no lab data measurements of Sor for comparison, then engineers can use the results shown in FIG. 7 to assess the calculated Sor is within acceptable ranges for a specific oil field. In some examples, predicting the recovery of the oil from the reservoir using the residual oil saturation in the computational model of the reservoir includes plotting the residual oil saturation as a function of a depth in a wellbore located within the reservoir.

At step 314, the method includes predicting a recovery of the oil from the reservoir 150 using the residual oil saturation in a computational model of the reservoir 150. In some examples, an engineer generates the computational model of the reservoir using a modeling software (e.g., Schlumberger's PETREL software). In some examples, the computational model is used to perform a static simulation where dynamic effects (e.g., inertia, rate, and pressure variations) are negligible and not accounted to determine the location-specific residual oil saturation. Then the location-specific residual oil saturation values are used in a dynamic simulation where these dynamic effects are accounted for in the solution (e.g., such that the flow of the displacing fluid and the oil through the reservoir is solved) to predict the recovery of the oil from the reservoir. In some examples, dynamic effects are considered to account for injection efficiency. Further details about the computational model is described with reference to FIG. 9 below.

Figure 9:
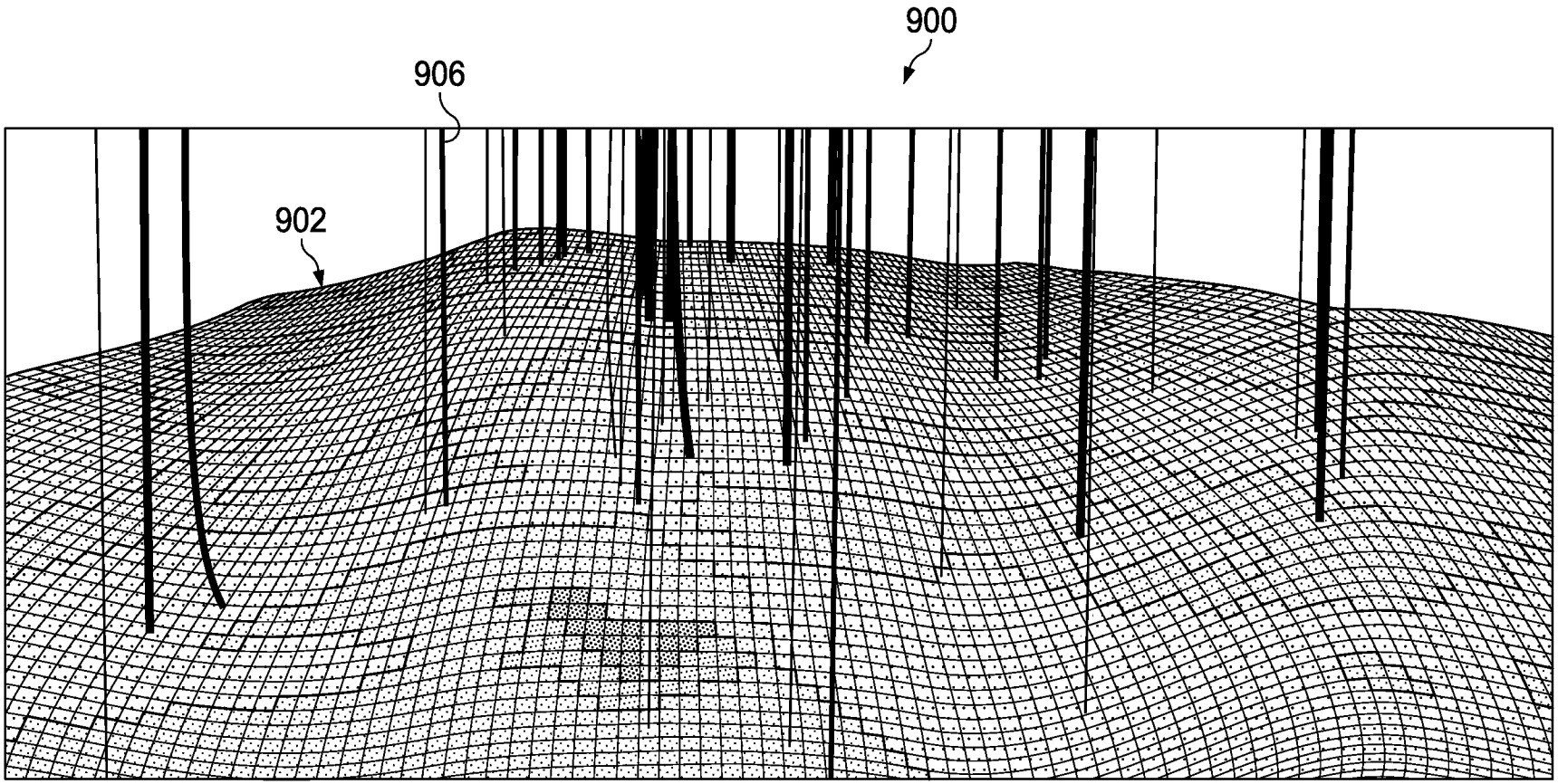
FIG. 9 is an image of a computational model of the reservoir of the wellbore system shown in FIG. 1 for determining the location-specific residual oil saturation throughout the reservoir.

FIG. 9 is an image of a computational model of the reservoir. In some examples, the computational model 900 is used to visualize one or more surfaces 902 of the reservoir in three-dimensional (3D) space. In some examples, the computational model 900 is generated using information from well logs. In the example shown, each vertical line 906 represents the space spanned by each respective well log. In most cases, well log information is used to identify the top and bottom of a reservoir (e.g., using wells that penetrate the entire reservoir) along with internal zones and layers. Well log information (e.g., porosity, permeability, initial saturation, etc.) is assigned to each grid cell 904 by finding the grid cells 902 that a well penetrates and assigning one discrete value of each of these properties to each cell 904 in the vertical direction. These properties are then distributed away from the locations of the well logs using statistical methods such as Kriging or Gaussian to fill. For example, the values of the properties of the reservoir between the well log positions is interpolated by the modeling software.

In the example shown, the reservoir is discretized using a plurality of grid cells 904 and the residual oil saturation is determined (e.g., by a numerical solver) in each of those grid cells 904. Since the residual oil location is location-specific throughout the reservoir, contours are used to represent the residual oil saturation at a particular location within the reservoir.

The computational model 900 is solved to calculate each parameter of Table 1 in each grid cell 902. In some examples, predicting the recovery of the oil from the reservoir includes using both a static computational model and a dynamic computational model to predict the recovery of the oil from the reservoir. In some examples, a static simulation is solved first and then a dynamic simulation is solved based on the results of the static simulation. In some examples, the static computational model does not account for a rate and a pressure variation of the oil while the dynamic computational model does account for the rate and the pressure variation of the oil.

In some example, a permeability array (e.g., an array as a function of position within the reservoir) is determined from the static simulation. In some examples, the array is a 1D vector. In some examples, the array is a 2D matrix. In some examples, the permeability array is exported from the static simulation to define location-specific permeability information of the reservoir (e.g., because each grid cell 904 has a different permeability) as input to the dynamic simulation. In some examples, the static simulation is made dynamic by incorporating rate and pressure data.

In some examples, the oil viscosity is extracted from a separate static simulation that uses the same computational model and used in the dynamic simulation. In some examples, the oil viscosity is extracted from the static simulation that uses the same computational model and used in the dynamic simulation. In this way, the dynamic computational model is used to predict the recovery of the oil from the reservoir based on the residual oil saturation from the static computational model.

In some examples, determining the residual oil saturation involves programming Eqs. 1-7 into a subroutine within the modeling software so that the modeling software computes each Eqs. 1-7 as part of the solution method to determine the residual oil saturation throughout the reservoir. Programming Eqs. 1-7 into the modeling software is further explained with reference to FIG. 10 below.

Figure 10:
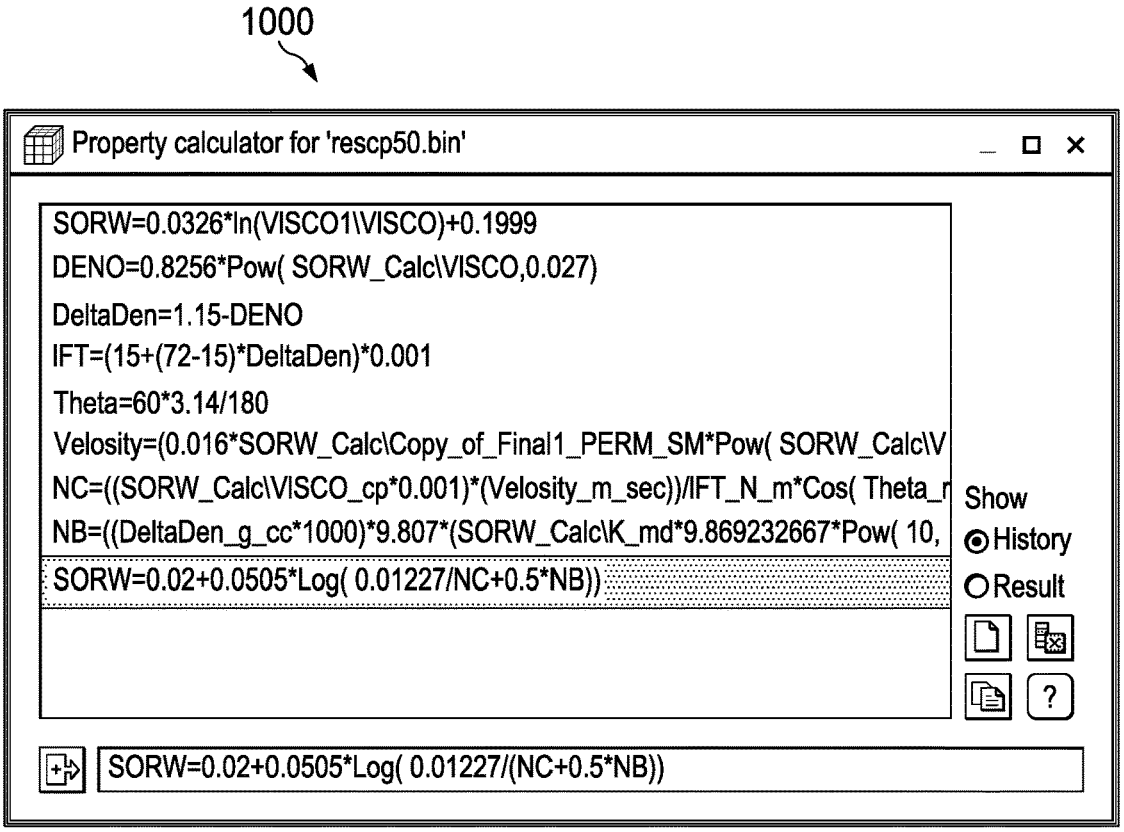
FIG. 10 is a dialog box showing calculations for determining the location-specific residual oil saturation as part of the computational model shown in FIG. 9.

FIG. 10 is a dialog box showing calculations 1000 for determining the location-specific residual oil saturation as part of the computational model 900. In the example shown, each of Eqs. 1-7 are programmed into a subroutine to determine the residual oil saturation of the reservoir. In FIG. 10, some programmed equations are truncated for brevity and not shown in full.

Figure 11:
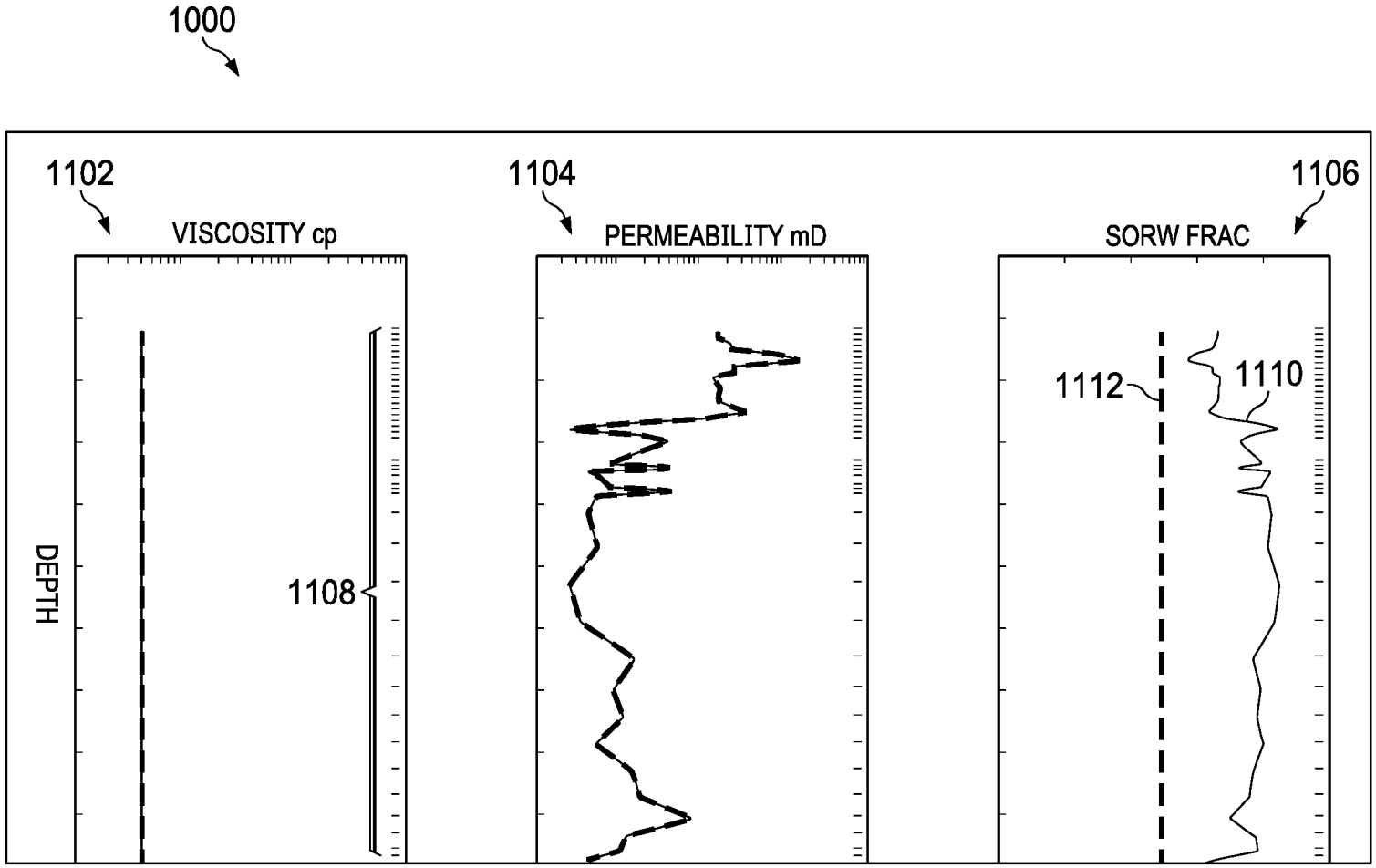
FIG. 11 is a plot of viscosity, permeability, and residual oil saturation of the reservoir of the wellbore system shown in FIG. 1 as a function of depth of the reservoir illustrating an example where viscosity is constant as a function of depth of the reservoir.
Figure 12:
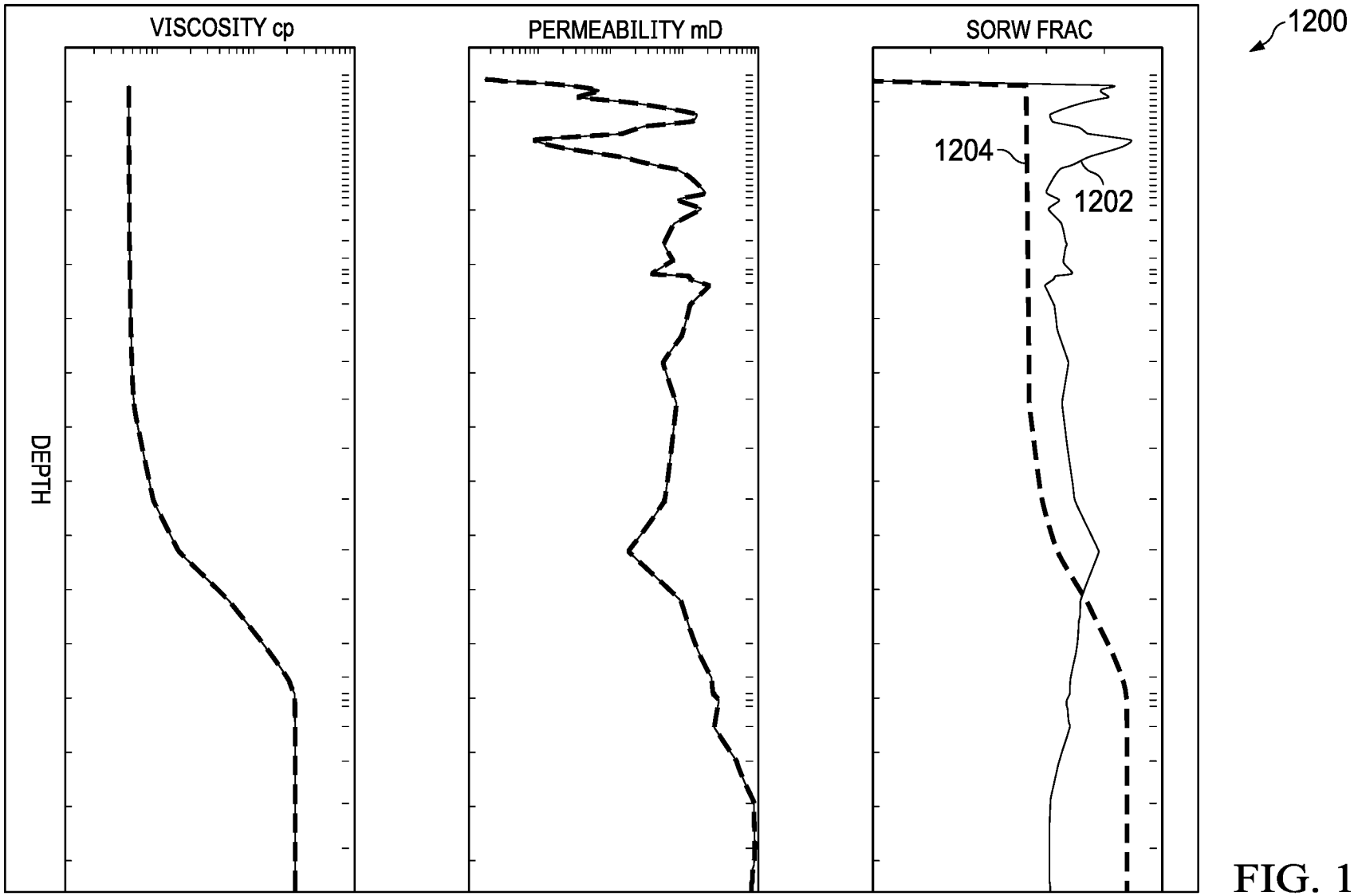
FIG. 12 is a plot of viscosity, permeability, and residual oil saturation of the reservoir of the wellbore system shown in FIG. 1 as a function of depth of the reservoir illustrating an example where viscosity varies as a function of depth of the reservoir.

As noted above, the residual oil saturation is plotted after it is determined using the computational model. In some examples, the residual oil saturation is plotted as a function of depth for potential wellbore locations to predict an amount of oil recovery for specific wellbore locations. FIGS. 11 and 12 illustrate example plots of residual oil saturation for wellbore locations.

FIG. 11 is a plot of viscosity, permeability, and residual oil saturation of the reservoir as a function of depth of the reservoir. In this example, FIG. 11 represents a potential wellbore location where the depth corresponds to depth at the particular wellbore location. FIG. 11 illustrates an example where oil viscosity (represented in column 1102) is constant as a function of depth of the wellbore. The location-specific permeability is represented in column 1104 and varies as a function of depth of the wellbore. The residual oil saturation is represented in column 1106 and also varies as a function of depth of the wellbore.

Depth of the wellbore is represented by the vertical axis while magnitudes of viscosity, permeability, and residual oil saturation, increase from left-to-right on the horizontal axis. The magnitudes have been normalized and may not represent physical values. The gray markers 1108 represent downhole locations where the wellbore is perforated.

Two results are shown in FIG. 11. The result represented in the solid line 1110 represents the residual oil saturation as determined using Eqs. 1-7 in the computational model. The result represented in the dotted line 1112 represents the residual oil saturation as determined using Aboujafar's method for comparison purposes. As noted above, Aboujafar's method does not account for permeability variations. Aboujafar's method only accounts for variations in viscosity. As a result, in this example the residual oil saturation prediction using Aboujafar's method is constant as a function of depth which is different compared to the results determined using Eqs. 1-7 in the computational model.

FIG. 12 is a plot of viscosity, permeability, and residual oil saturation of the reservoir as a function of depth of the wellbore illustrating an example where viscosity varies as a function of depth of the reservoir. The result represented in the solid line 1202 represents the residual oil saturation as determined using Eqs. 1-7 in the computational model while the result represented in the dotted line 1204 represents the residual oil saturation as determined using Aboujafar's method. The residual oil saturation as determined using Aboujafar's method varies proportionally with viscosity and does not account for variations in permeability. The residual oil saturation as determined using Eqs. 1-7 varies as a function of both viscosity and permeability. The lower region of the plot (e.g., associated with greater depths) of FIG. 12 illustrates how permeability greatly affects the residual oil saturation determination.

In some examples, the method includes determining a location for a production well site based on the residual oil saturation prediction. For example, determining the location for the production well site in areas of the reservoir with low residual oil saturation values is preferable over areas of the reservoir with high residual oil saturation values. Once a production well site is determined, the well is drilled into the ground, the well casing is installed, and one or more perforations are positioned in the casing (e.g., as described with reference to the production well 102 shown in FIG. 1).

At step 316, the method includes pumping the displacing fluid into the reservoir to cause the recovery of the oil from the reservoir. In some examples, a pump is used to pump the displacing fluid into the reservoir 150 to cause the recovery of the oil from the reservoir 150. For example, an injection well (e.g., the injection well 104 shown in FIG. 1) can be used to pump the displacing fluid into the reservoir to cause the oil to flow into the production well through the one or more perforations and up to the ground surface of the production well. This causes a recovery of the oil from the reservoir. In some examples, the pump is the pump 132 shown in FIG. 1. In some examples, the residual oil saturation is used to estimate oil reserves of a reservoir, determine recovery factors of the reservoir, and/or determine Enhanced Oil Recovery (EOR) application decisions.

Figure 13:
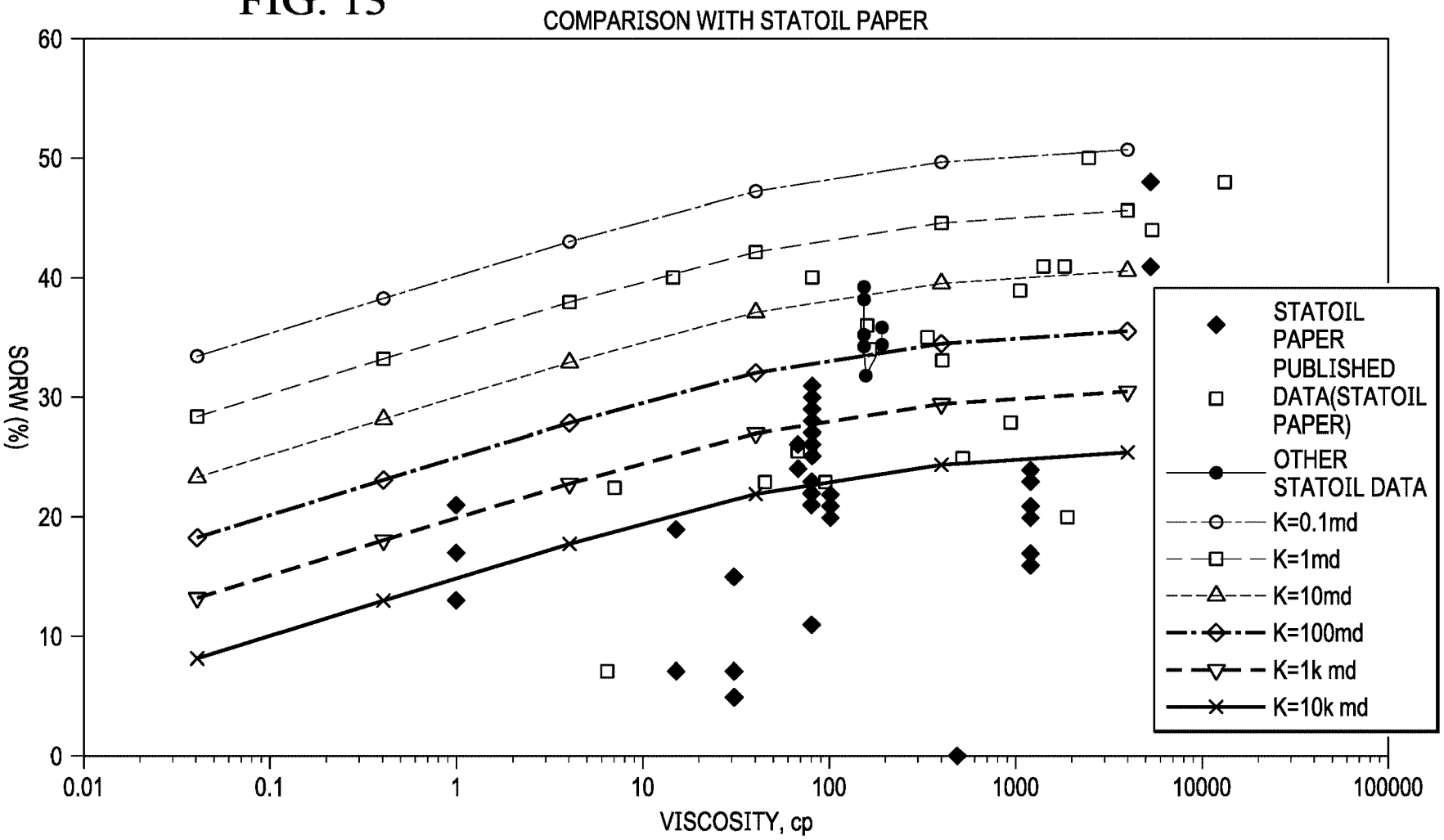
FIGS. 13-16 are plots showing a verification of the systems and methods described in this specification.
Figure 14:
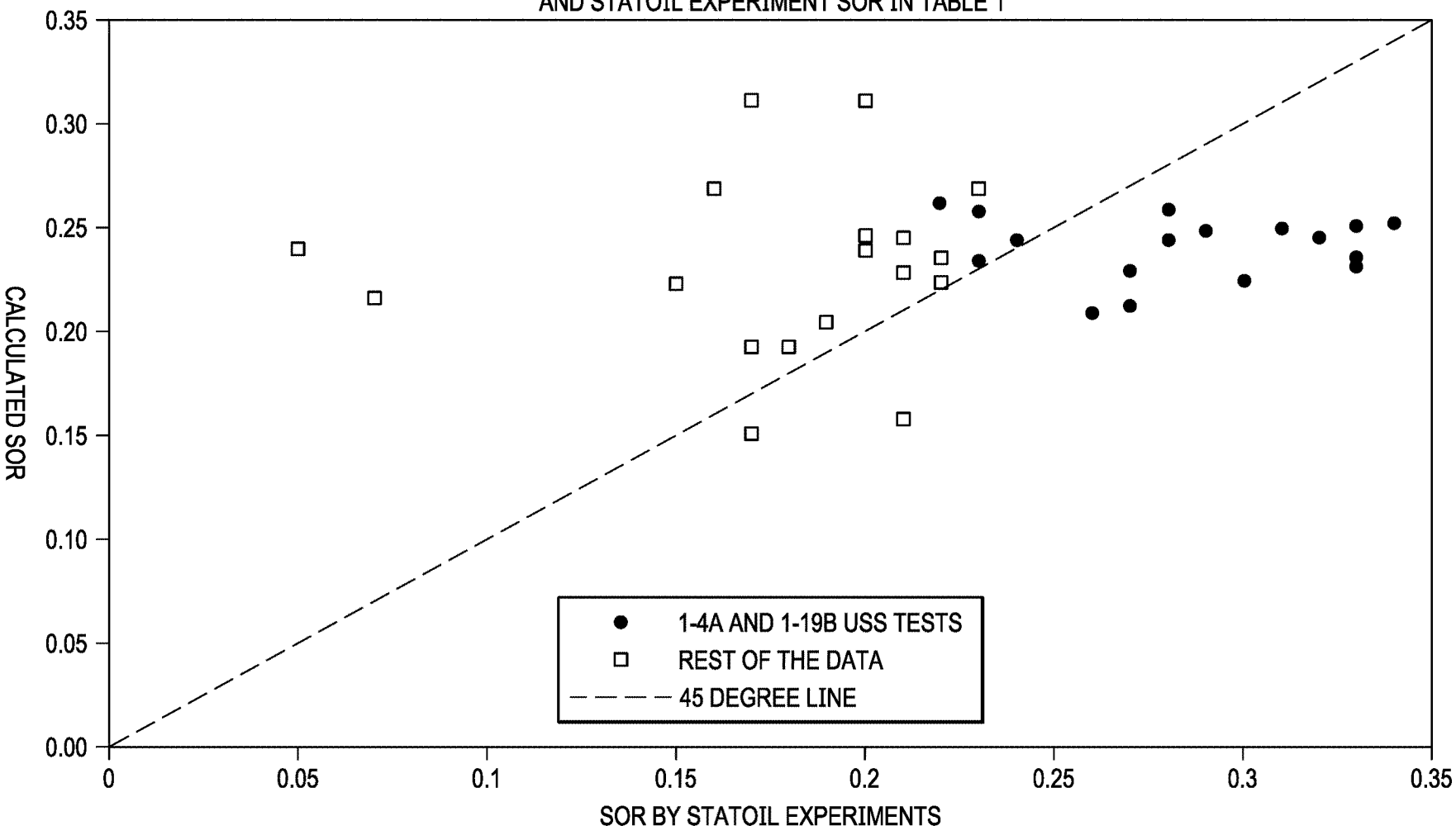
Figure 15:
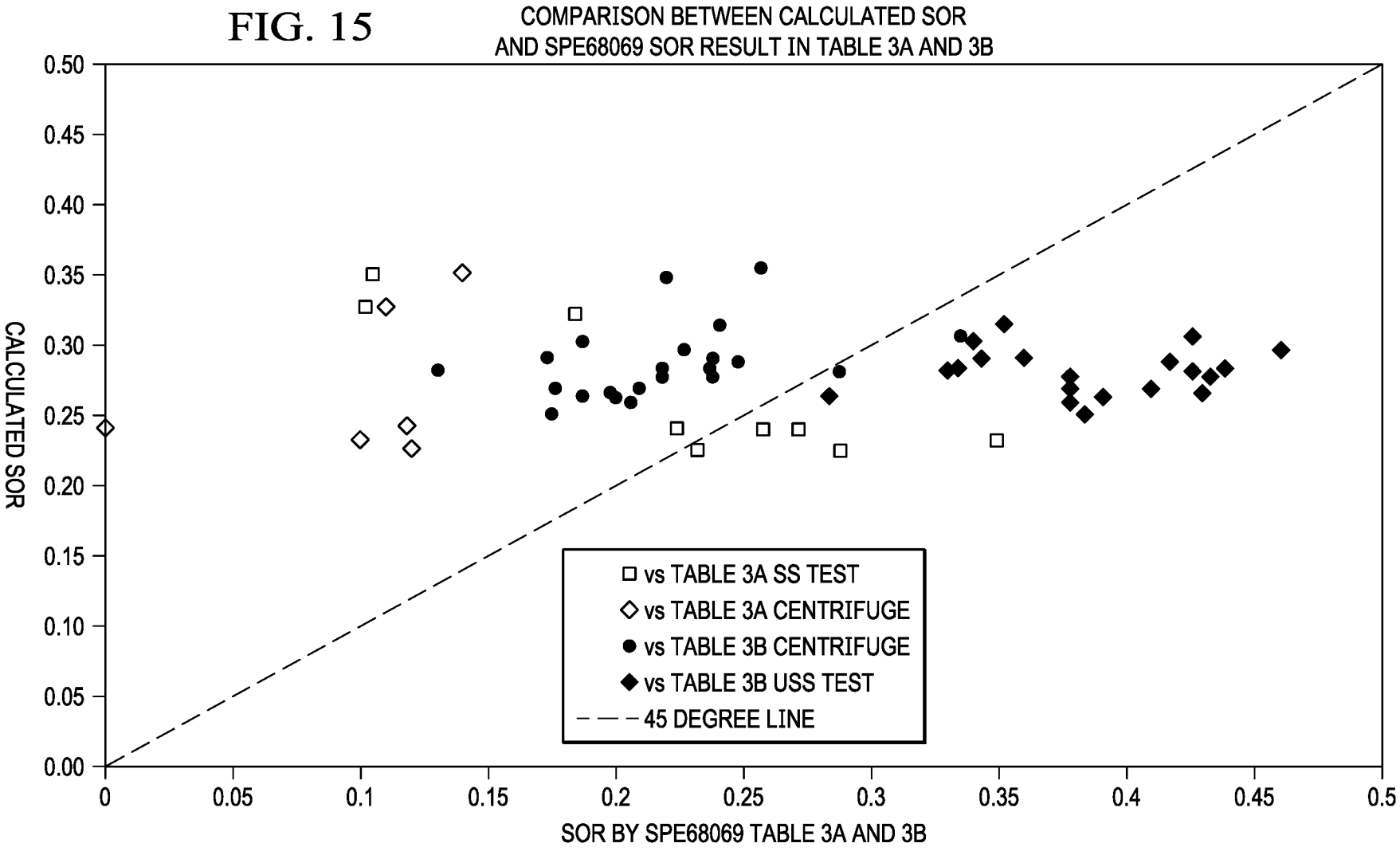

FIGS. 13-15 are plots showing a verification of the systems and methods described in this specification. The results were validated using reference data (e.g., Statoil reference data—Katayoun S Nejad, Eirik Asbjørn Berg, Jon Knut Ringen, *STATOIL* (2011, *September* 18-21). *Effect of Oil Viscosity on Water/Oil Relative Permeability. International Symposium of the Society of Core Analysts. doi: CA*2011-12). In some cases, validation requires careful treatment because of a wide range of $S_{or}$ results (e.g., 20-30% variations). For example, when 80 cp oil is used, the $S_{or}$ results show a variance of about 20 to 30%. Despite this variance, the systems and methods described in this specification illustrate generally a conservative result compared to the reference data. For example, FIG. 13 shows results of Eqs. 1-7 using lines while the reference data is represented in markers. The results of Eqs. 1-7 indicate a higher residual oil saturation than the reference data.

FIG. 14 shows a comparison between the residual oil saturation determined using Eqs. 1-7 and each plug of the reference Statoil experiments. The results show that the results obtained using the methods based on Eqs. 1-7 above are optimistic (e.g., less Sor, more mobile oil, etc.) than the 1-4A and 1-19B USS experiments described in that reference. The results also show that the results obtained using the methods based on Eqs. 1-7 above are conservative (e.g., more Sor, less mobile oil, etc.) than the rest of the experiments described in that reference.

In FIG. 14, the y-axis represents the calculated Sor based on Franklin's equation (Eq. 1) and the approach described above while the x-axis represents Sor based on Statoil experiments. The 45 degree line visualizes a difference between the Sor based on Franklin's equation (Eq. 1) and the approach described above and the Sor based on Statoil experiments. Data points above the 45 degree line represent calculated Sor values based on Franklin's equation (Eq. 1) that are greater than the Sor values based on Statoil experiments (e.g., a less conservative Sor calculation). Data points below the 45 degree line represent calculated Sor values based on Franklin's equation (Eq. 1) that are less than the Sor values based on Statoil experiments (e.g., a more conservative Sor calculation). Some reasons why the method of Eqs. 1-7 produce residual oil saturation results that is less conservative is because of possible contaminated core plugs (e.g., damaged core plugs were used in experiments, etc.), contaminated test conditions (e.g., experiments conditions were not checked before conducting the experiments, etc.). For example, the conditions of the core plugs are generally not reported in published data sets and it is hard to assess the validity of the data when the conditions of the core plugs are unknown. In some examples, lab results of the core plugs are exposed to smoothing and/or adjustments which can also affect the results of the measurements. Details regarding smoothing and/or adjustments to the data are also usually lacking from the publications.

Figure 16:
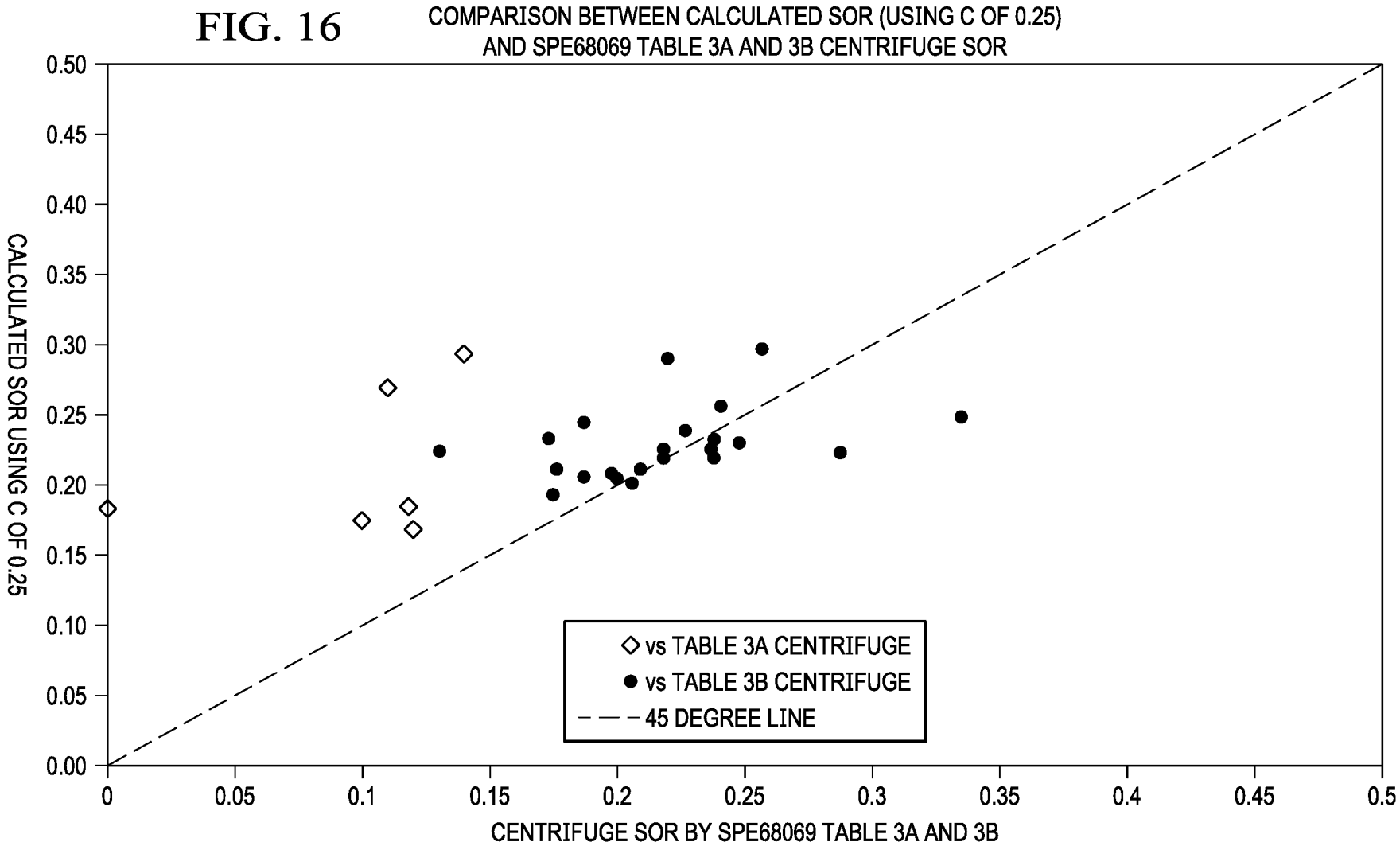

FIGS. 15 and 16 are comparisons of the methods based on Eqs. 1-7 with the data described in SPE-68069 Tables 3A and 3B. FIG. 15 shows results based on a calibration constant C of 0.016 and FIG. 16 shows results based on a calibration constant of 0.25. In the SPE-68069 reference, Table 3A represents SS and centrifuge experiments and Table 3B represents USS and centrifuge experiments. These tables summarize different core plug lab experiments (e.g., the SS and centrifuge testing of Table 3A is different from the USS and centrifuge testing of Table 3B). Additionally, Tables 3A and 3B indicate that the Sor results associated with centrifuge testing are less than the Sor results associated with SS and USS testing. This behavior is consistent with general knowledge that Sor results obtained from correctly designed centrifuge imbibition tests should be lower than Sor results obtained directly from waterflood tests. In some cases, the Sor results obtained from correctly designed centrifuge imbibition tests are closer to the true residual oil saturation from the reservoir.

The results of FIG. 15 show that the results obtained using the methods based on Eqs. 1-7 above are generally optimistic (e.g., less Sor, more mobile oil, etc.) compared to the Table 3A SS and the Table 3B USS experiments described in the SPE-68069 reference. The results of FIG. 15 also show that the results obtained using the methods based on Eqs. 1-7 above have a generally closer match to the centrifuge results described in the SPE-68069 reference. As noted above, a calibration constant C of 0.016 is used in to generate the results shown in FIG. 15.

As also noted above, a calibration constant C of 0.25 is used in generate the results shown in FIG. 16. In this example, a calibration constant C of 0.25 is used because the published experiments were conducted by a centrifuge experiment. In some cases, a higher calibration constant is used with centrifuge experiments vs. SS and/or USS experiments. In this example, a calibration constant C of 0.016 would result in conservative results (e.g., as shown in FIG. 15). In this way, starting with a calibration constant C of 0.016 results in a good approximation of the residual oil saturation of a reservoir. Additionally, the calibration constant C can be adjusted once lab and/or field data (e.g., field residual oil saturation data) arrives to improve the residual oil prediction further. For example, the approach followed here of (i) plotting the results of Eqs. 1-7 for various calibration constants and (ii) comparing these results against lab and/or field data can be used to determine the calibration constant C that is most consistent with the lab and/or field data.

Figure 17:
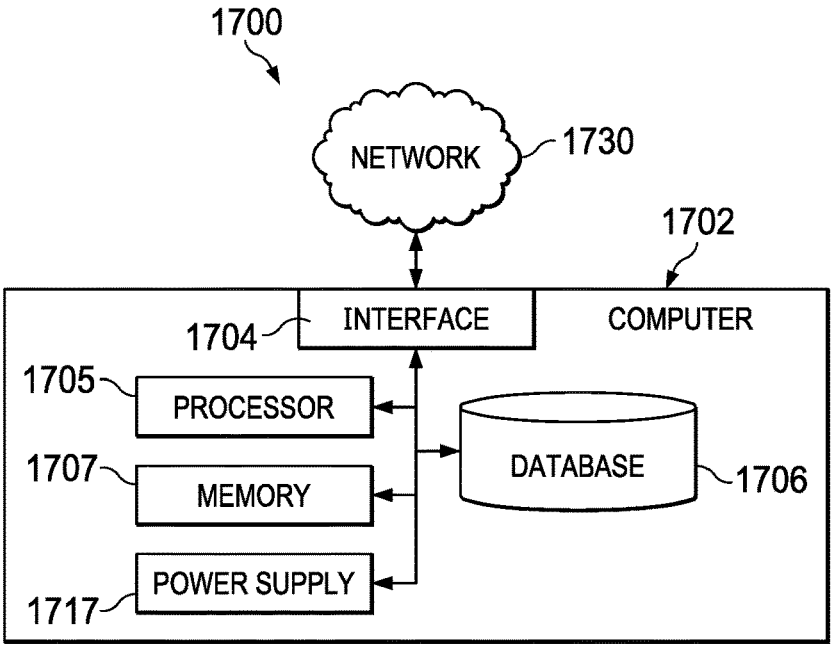
FIG. 17 is a schematic illustration of an example controller for determining the residual oil saturation of the reservoir of the wellbore system shown in FIG. 1.

FIG. 17 is a block diagram of an example computer system 1700 that can be used to provide computational functionalities associated with described algorithms, methods, functions, processes, flows, and procedures described in the present disclosure. In some implementations, the computer system 1700 performs one or more steps of the method described with reference to FIG. 3. In some examples, the computer system 1700 performs steps 308, 310, 312, and 314. In some examples, the computer system 1700 transmits a signal instructing a pump to pump displacing fluid into the reservoir as part of step 316.

The illustrated computer 1702 is intended to encompass any computing device such as a server, a desktop computer, an embedded computer, a laptop/notebook computer, a wireless data port, a smart phone, a personal data assistant (PDA), a tablet computing device, or one or more processors within these devices, including physical instances, virtual instances, or both. The computer 1702 can include input devices such as keypads, keyboards, and touch screens that can accept user information. Also, the computer 1702 can include output devices that can convey information associated with the operation of the computer 1702. The information can include digital data, visual data, audio information, or a combination of information. The information can be presented in a graphical user interface (UI) (or GUI). In some implementations, the inputs and outputs include display ports (such as DVI-I+2× display ports), USB 3.0, GbE ports, isolated DI/O, SATA-III (6.0 Gb/s) ports, mPCIe slots, a combination of these, or other ports. In instances of an edge gateway, the computer 1702 can include a Smart Embedded Management Agent (SEMA), such as a built-in ADLINK SEMA 2.2, and a video sync technology, such as Quick Sync Video technology supported by ADLINK MSDK+. In some examples, the computer 1702 can include the MXE-5400 Series processor-based fanless embedded computer by ADLINK, though the computer 1702 can take other forms or include other components.

The computer 1702 can serve in a role as a client, a network component, a server, a database, a persistency, or components of a computer system for performing the subject matter described in the present disclosure. The illustrated computer 1702 is communicably coupled with a network 1730. In some implementations, one or more components of the computer 1702 can be configured to operate within different environments, including cloud-computing-based environments, local environments, global environments, and combinations of environments.

At a high level, the computer 1702 is an electronic computing device operable to receive, transmit, process, store, and manage data and information associated with the described subject matter. According to some implementations, the computer 1702 can also include, or be communicably coupled with, an application server, an email server, a web server, a caching server, a streaming data server, or a combination of servers.

The computer 1702 can receive requests over network 1730 from a client application (for example, executing on another computer 1702). The computer 1702 can respond to the received requests by processing the received requests using software applications. Requests can also be sent to the computer 1702 from internal users (for example, from a command console), external (or third) parties, automated applications, entities, individuals, systems, and computers.

Each of the components of the computer 1702 can communicate using a system bus. In some implementations, any or all of the components of the computer 1702, including hardware or software components, can interface with each other or the interface 1704 (or a combination of both), over the system bus. Interfaces can use an application programming interface (API), a service layer, or a combination of the API and service layer. The API can include specifications for routines, data structures, and object classes. The API can be either computer-language independent or dependent. The API can refer to a complete interface, a single function, or a set of APIs.

The service layer can provide software services to the computer 1702 and other components (whether illustrated or not) that are communicably coupled to the computer 1702. The functionality of the computer 1702 can be accessible for all service consumers using this service layer. Software services, such as those provided by the service layer, can provide reusable, defined functionalities through a defined interface. For example, the interface can be software written in JAVA, C++, or a language providing data in extensible markup language (XML) format. While illustrated as an integrated component of the computer 1702, in alternative implementations, the API or the service layer can be standalone components in relation to other components of the computer 1702 and other components communicably coupled to the computer 1702. Moreover, any or all parts of the API or the service layer can be implemented as child or sub-modules of another software module, enterprise application, or hardware module without departing from the scope of the present disclosure.

The computer 1702 can include an interface 1704. Although illustrated as a single interface 1704 in FIG. 17, two or more interfaces 1704 can be used according to particular needs, desires, or particular implementations of the computer 1702 and the described functionality. The interface 1704 can be used by the computer 1702 for communicating with other systems that are connected to the network 1730 (whether illustrated or not) in a distributed environment. Generally, the interface 1704 can include, or be implemented using, logic encoded in software or hardware (or a combination of software and hardware) operable to communicate with the network 1730. More specifically, the interface 1704 can include software supporting one or more communication protocols associated with communications. As such, the network 1730 or the interface's hardware can be operable to communicate physical signals within and outside of the illustrated computer 1702.

The computer 1702 includes a processor 1705. Although illustrated as a single processor 1705 in FIG. 17, two or more processors 1705 can be used according to particular needs, desires, or particular implementations of the computer 1702 and the described functionality. Generally, the processor 1705 can execute instructions and can manipulate data to perform the operations of the computer 1702, including operations using algorithms, methods, functions, processes, flows, and procedures as described in the present disclosure.

The computer 1702 can also include a database 1706 that can hold data for the computer 1702 and other components connected to the network 1730 (whether illustrated or not). For example, database 1706 can be an in-memory, conventional, or a database storing data consistent with the present disclosure. In some implementations, database 1706 can be a combination of two or more different database types (for example, hybrid in-memory and conventional databases) according to particular needs, desires, or particular implementations of the computer 1702 and the described functionality. Although illustrated as a single database 1706 in FIG. 17, two or more databases (of the same, different, or combination of types) can be used according to particular needs, desires, or particular implementations of the computer 1702 and the described functionality. While database 1706 is illustrated as an internal component of the computer 1702, in alternative implementations, database 1706 can be external to the computer 1702.

The computer 1702 also includes a memory 1707 that can hold data for the computer 1702 or a combination of components connected to the network 1730 (whether illustrated or not). Memory 1707 can store any data consistent with the present disclosure. In some implementations, memory 1707 can be a combination of two or more different types of memory (for example, a combination of semiconductor and magnetic storage) according to particular needs, desires, or particular implementations of the computer 1702 and the described functionality. Although illustrated as a single memory 1707 in FIG. 17, two or more memories 1707 (of the same, different, or combination of types) can be used according to particular needs, desires, or particular implementations of the computer 1702 and the described functionality. While memory 1707 is illustrated as an internal component of the computer 1702, in alternative implementations, memory 1707 can be external to the computer 1702.

An application can be an algorithmic software engine providing functionality according to particular needs, desires, or particular implementations of the computer 1702 and the described functionality. For example, an application can serve as one or more components, modules, or applications. Multiple applications can be implemented on the computer 1702. Each application can be internal or external to the computer 1702.

The computer 1702 can also include a power supply 1714. The power supply 1714 can include a rechargeable or non-rechargeable battery that can be configured to be either user- or non-user-replaceable. In some implementations, the power supply 1714 can include power-conversion and management circuits, including recharging, standby, and power management functionalities. In some implementations, the power-supply 1714 can include a power plug to allow the computer 1702 to be plugged into a wall socket or a power source to, for example, power the computer 1702 or recharge a rechargeable battery.

There can be any number of computers 1702 associated with, or external to, a computer system including computer 1702, with each computer 1702 communicating over network 1730. Further, the terms "client," "user," and other appropriate terminology can be used interchangeably, as appropriate, without departing from the scope of the present disclosure. Moreover, the present disclosure contemplates that many users can use one computer 1702 and one user can use multiple computers 1702.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non transitory, computer-readable computer-storage medium for execution by, or to control the operation of, data processing apparatus. Alternatively, or additionally, the program instructions can be encoded in/on an artificially generated propagated signal. The example, the signal can be a machine-generated electrical, optical, or electromagnetic signal that is generated to encode information for transmission to suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatus, devices, and machines for processing data, including by way of example, a programmable processor, a computer, or multiple processors or computers. The apparatus can also include special purpose logic circuitry including, for example, a central processing unit (CPU), a field programmable gate array (FPGA), or an application specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, for example, Linux, Unix, Windows, Mac OS, Android, or iOS.

A computer program, which can also be referred to or described as a program, software, a software application, a module, a software module, a script, or code, can be written in any form of programming language. Programming languages can include, for example, compiled languages, interpreted languages, declarative languages, or procedural languages. Programs can be deployed in any form, including as stand alone programs, modules, components, subroutines, or units for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files storing one or more modules, sub programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes, the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory. A computer can also include, or be operatively coupled to, one or more mass storage devices for storing data. In some implementations, a computer can receive data from, and transfer data to, the mass storage devices including, for example, magnetic, magneto optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer readable media (transitory or non-transitory, as appropriate) suitable for storing computer program instructions and data can include all forms of permanent/non-permanent and volatile/non volatile memory, media, and memory devices. Computer readable media can include, for example, semiconductor memory devices such as random access memory (RAM), read only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer readable media can also include, for example, magnetic devices such as tape, cartridges, cassettes, and internal/removable disks. Computer readable media can also include magneto optical disks and optical memory devices and technologies including, for example, digital video disc (DVD), CD ROM, DVD+/−R, DVD-RAM, DVD-ROM, HD-DVD, and BLU-RAY. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated in, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), and a plasma monitor. Display devices can include a keyboard and pointing devices including, for example, a mouse, a trackball, or a trackpad. User input can also be provided to the computer through the use of a touchscreen, such as a tablet computer surface with pressure sensitivity or a multi-touch screen using capacitive or electric sensing. Other kinds of devices can be used to provide for interaction with a user, including to receive user feedback including, for example, sensory feedback including visual feedback, auditory feedback, or tactile feedback. Input from the user can be received in the form of acoustic, speech, or tactile input. In addition, a computer can interact with a user by sending documents to, and receiving documents from, a device that is used by the user. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touch screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for read and update. Locking or consistency tracking may not be necessary since the locking of exchange file system can be done at application layer. Furthermore, Unicode data files can be different from non-Unicode data files.

A number of implementations of the systems and methods have been described. Nevertheless, it will be understood that various modifications may be made without departing from the spirit and scope of this disclosure. Accordingly, other implementations are within the scope of the following claims.

What is claimed is:

1. A method for determining a residual oil saturation of a reservoir, the method comprising:

obtaining a plurality of rock samples from the reservoir;

determining a permeability of each of the rock samples;

measuring a fluid viscosity of oil in the reservoir;

estimating a location-specific permeability of the reservoir across the reservoir based on the permeability of each of the rock samples;

determining a location-specific displacing velocity of the reservoir based on a function of the location-specific permeability and the fluid viscosity of the oil, the function having a proportional relationship to the location-specific permeability and an inverse relationship to the fluid viscosity;

determining the residual oil saturation of the reservoir based on the location-specific displacing velocity using Franklin's equation, wherein Franklin's equation is defined as Sor=0.02+0.0505*log(0.01227/(Nc+0.5*Nb)), where Sor is the residual oil saturation, Nc is the capillary number, and Nb is the Bond number; and predicting a recovery of the oil from the reservoir using the residual oil saturation in a computational model of the reservoir.

2. The method of claim 1, wherein the location-specific displacing velocity represents a velocity of an interface between the oil and a displacing fluid within the reservoir.

3. The method of claim 2, wherein the displacing fluid is water.

4. The method of claim 2, further comprising pumping the displacing fluid into the reservoir to cause the recovery of the oil from the reservoir.

5. The method of claim 1, wherein determining the location-specific displacing velocity of the reservoir comprises evaluating the following equation: nu=c*k*mu^(−2), where nu is the location-specific displacing velocity, c is a constant, k is the location-specific permeability of the reservoir, and mu is the fluid viscosity of the oil.

6. The method of claim 5, further comprising determining c based on experimental data.

7. The method of claim 5, wherein an initial value of c is 0.016.

8. The method of claim 7, further comprising adjusting the initial value of c to a different value based on experimental data.

9. The method of claim 1, wherein predicting the recovery of the oil from the reservoir using the residual oil saturation in the computational model of the reservoir comprises plotting the residual oil saturation as a function of a depth in a wellbore located within the reservoir.

10. The method of claim 1, wherein predicting the recovery of the oil from the reservoir using the residual oil saturation in the computational model of the reservoir comprises using both a static computational model and a dynamic computational model to predict the recovery of the oil from the reservoir.

11. The method of claim 10, further comprising:

estimating a fluid viscosity of the oil in the reservoir; and estimating a location-specific permeability of the reservoir across the reservoir, wherein determining the location-specific displacing velocity of the reservoir comprises evaluating the following equation: nu=c*k*mu^(−2), where nu is the location-specific displacing velocity, c is a constant, k is the location-specific permeability of the reservoir, and mu is the fluid viscosity of the oil.

12. The method of claim 10, wherein determining the residual oil saturation of the reservoir is based on a wettability angle and the wettability angle is between 30° and 65°.

13. The method of claim 1, wherein predicting the recovery of the oil from the reservoir accounts for an injection efficiency of the reservoir.

14. A method for determining a residual oil saturation of a reservoir, the method comprising:

determining a location-specific displacing velocity of the reservoir, the location-specific displacing velocity representing a velocity of an interface between an oil and a displacing fluid within the reservoir;

determining the residual oil saturation of the reservoir based on the location-specific displacing velocity using Franklin's equation, wherein Franklin's equation is defined as Sor=0.02+0.0505*log(0.01227/(Nc+0.5*Nb)), where Sor is the residual oil saturation, Nc is the capillary number, and Nb is the Bond number;

predicting a recovery of the oil from the reservoir using the residual oil saturation in a computational model of the reservoir; and pumping the displacing fluid into the reservoir to cause the recovery of the oil from the reservoir.

15. The method of claim 14, wherein predicting the recovery of the oil from the reservoir using the residual oil saturation in the computational model of the reservoir comprises using both a static computational model and a dynamic computational model to predict the recovery of the oil from the reservoir because in really it is a function also of injection efficiency.

16. The method of claim 15, wherein the static computational model is used to determine the residual oil saturation in one or more grid cells of the static computational model, the static computation model not accounting for a rate and a pressure variation of the oil.

17. The method of claim 16, wherein the dynamic computational model is used to predict the recovery of the oil from the reservoir based on the residual oil saturation from the static computational model, the dynamic computation model accounting for the rate and the pressure variation of the oil.

18. The method of claim 14, further comprising estimating an interfacial tension between the displacing fluid and the oil and using the interfacial tension in Franklin's equation.

19. The method of claim 18, wherein estimating the interfacial tension comprises estimating the interfacial tension using Ramey's correlation.

20. A method for determining a residual oil saturation of a reservoir, the method comprising:

estimating a fluid viscosity of the oil in the reservoir;

estimating a location-specific permeability of the reservoir across the reservoir;

determining a location-specific displacing velocity of the reservoir by evaluating the following equation: nu=c*k*mu^(−2), where nu is the location-specific displacing velocity, c is a constant, k is the location-specific permeability of the reservoir, and mu is the fluid viscosity of an oil of the reservoir;

determining the residual oil saturation of the reservoir based on the location-specific displacing velocity using Franklin's equation, wherein Franklin's equation is defined as Sor=0.02+0.0505*log (0.01227/(Nc+0.5*Nb)), where Sor is the residual oil saturation, Nc is the capillary number, and Nb is the Bond number;

predicting a recovery of the oil from the reservoir using the residual oil saturation in a computational model of the reservoir; and pumping a displacing fluid into the reservoir to cause the recovery of the oil from the reservoir, wherein Franklin's equation's is based on a mass density of the displacing fluid.

* * * * *